US010684580B2

(12) United States Patent
Kadowaki et al.

(10) Patent No.: US 10,684,580 B2
(45) Date of Patent: Jun. 16, 2020

(54) IMAGE FORMING APPARATUS HAVING AN IMAGE READER FOR MEASURING THE WIDTH OF A NIP OF THE IMAGE FORMING APPARATUS

(71) Applicant: CANON KABUSHIKI KAISHA, Tokyo (JP)

(72) Inventors: Hiroyuki Kadowaki, Boise, ID (US); Eiji Uekawa, Susono (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/287,695

(22) Filed: Feb. 27, 2019

(65) Prior Publication Data

US 2019/0265620 A1 Aug. 29, 2019

(30) Foreign Application Priority Data

Feb. 28, 2018 (JP) ..... 2018-034593

(51) Int. Cl.
*G03G 15/20* (2006.01)
*G03G 15/00* (2006.01)
*G03G 15/16* (2006.01)

(52) U.S. Cl.
CPC ..... *G03G 15/2039* (2013.01); *G03G 15/1675* (2013.01); *G03G 15/2053* (2013.01); *G03G 15/2064* (2013.01); *G03G 15/5062* (2013.01); *G03G 15/657* (2013.01); *G03G 2215/2035* (2013.01)

(58) Field of Classification Search
CPC ..... G03G 15/0189; G03G 15/1675; G03G 15/2039; G03G 15/2053; G03G 156/2064; G03G 15/5062; G03G 2215/2022; G03G 2215/2035
USPC ..... 399/38, 46, 49, 53, 55, 66, 67, 69, 72, 399/320, 328, 329
See application file for complete search history.

(56) References Cited

U.S. PATENT DOCUMENTS

| | | | | |
|---|---|---|---|---|
| 6,881,927 | B2 * | 4/2005 | Yoshinaga | G03G 15/2039 219/216 |
| 8,064,787 | B2 | 11/2011 | Blair et al. | |
| 9,213,284 | B2 * | 12/2015 | Okabayashi | G03G 15/2046 |
| 9,354,537 | B2 * | 5/2016 | Ueda | G03G 15/0131 |
| 2012/0070172 | A1 * | 3/2012 | Ota | G03G 15/2064 399/67 |

* cited by examiner

*Primary Examiner* — Hoan H Tran
(74) *Attorney, Agent, or Firm* — Venable LLP

(57) ABSTRACT

An image forming apparatus includes a device for forming a trace of an image fixing nip, primary transfer nip, secondary transfer nip or developing nip is formed, a detecting device for detecting a width of the nip from the trace of the nip, and a controller for controlling fixing, transferring, developing or image forming parameter in accordance with the nip width detected by the detecting device. Proper image forming conditions are provided against the change of the nip width.

11 Claims, 30 Drawing Sheets

IMAGE FORMING APPARATUS HAVING AN IMAGE READER FOR MEASURING THE WIDTH OF A NIP OF THE IMAGE FORMING APPARATUS

FIELD OF THE INVENTION AND RELATED ART

The present invention relates to an image forming apparatus such as an electrophotographic copying machine and an electrophotographic printer.

An electrophotographic printer has an image forming portion, which forms an image on recording medium, and a fixing portion (fixing apparatus) which fixes a toner image formed on recording medium to the recording medium.

A full-color printer, for example, forms an electrostatic latent image, which corresponds to the image to be formed, in its image forming portion. More specifically, the full-color printer charges the peripheral surface of a photosensitive drum to a preset polarity with the use of a charging member and forms the electrostatic latent image on the peripheral surface of the photosensitive drum with the use of a laser scanner. Then, the full-color printer develops the latent image on the peripheral surface of the photosensitive drum into a toner image in a development nip formed by a combination of the photosensitive drum and a development roller, using the toner.

Then, in a primary transfer nip, the full-color printer transfers the unfixed toner image on the peripheral surface of the photosensitive drum onto an outward surface of an intermediary transfer belt, using a 0 transferring member. The unfixed toner image is transferred in the primary transfer nip while the intermediary transfer belt is rotated. The intermediary transfer belt forms the primary transfer nip in coordination with the photosensitive drum. Then, the full-color printer transfers the unfixed toner image on the outward surface of the intermediary transfer belt onto recording medium using a secondary transferring member in a secondary transferring portion formed by the combination of the intermediary transfer belt and the secondary transferring member.

The fixing portion has: a rotational fixing member, such as a cylindrical film and a roller; a heater for heating the rotational fixing member; and a roller, as a rotational pressing member. The rotational pressing member, forms a fixation nip with the rotational fixing member. The recording medium, which is bearing an unfixed toner image, is heated while it is conveyed through the fixing nip and pinched between the rotational fixing member and rotational pressing member. Consequently, the unfixed toner image on the recording medium becomes fixed to the recording medium.

The roller, as a pressure applying rotational member, in the fixing portion described above has: a metallic core; an elastic layer formed on the peripheral surface of the metallic core; and a release layer formed on the outward surface of the elastic layer. As this roller is repeatedly subjected to the heat from the heater and the stress to which it is subjected as it feeds the recording medium, its elastic layer tends to deteriorate; it tends to reduce in hardness.

As the roller reduces in hardness, the fixation nip increases in width, in terms of the recording medium conveyance direction, increasing thereby the length of time the recording medium is heated in the fixation nip. As the length of time the recording medium is heated increases, the amount by which heat is supplied to the recording medium and the toner thereon increases, making it possible for the recording medium and toner to be supplied with an excessive amount of heat, which in turn makes it possible for the toner image to transfer (hot-offset) onto the outward surface of the film, and/or for the recording medium to curl after it is moved through the fixation nip.

There has been disclosed a technology which estimates the change in the nip width based on the cumulative number of sheets of recording medium processed by a fixing apparatus, in order to deal with the issues described above (specification of U.S. Pat. No. 8,064,787). According to this technology, if it is determined that a fixing apparatus has increased in nip width due to the increase in the cumulative number of sheets of recording medium processed by the fixing apparatus, the fixing apparatus is reduced in its target temperature level to prevent the recording medium and toner thereon from being supplied with an excessive amount of heat.

The amount of change in the width of the fixation nip in a printer, such as the one described above, is affected by the conditions under which the printer is used. That is, the amount of change in the nip width is affected by the thickness of each sheet of recording medium. Therefore, if the aforementioned technology is used to deal with the issues described above, it is possible for the roller to reduce in hardness sooner than expected, making it possible for the issued described above to occur. On the other hand, if the roller did not reduce in hardness as expected, issues related to insufficiency in the amount of heat supplied will occur. For example, an unfixed toner image may fail to be properly fixed. The failure in the toner fixation may also result in the fixing apparatus becoming jammed because of toner accumulating on the outward surface of the film and/or the peripheral surface of the roller. In other words, both cases invite image formation failure.

Further, the belt, secondary transferring member, and the like of a printer such as the one described above deteriorate with elapse of time. Therefore, it is possible for the width of the fixation nip of the printer, in terms of the belt rotation direction, to become different from the proper value, with the elapse of time. If the width becomes different from the proper value, it sometimes occurs that the primary transfer bias which is optimally set to be applied to the primary transferring member to transfer the toner image onto the belt cannot properly transfer the toner image onto the belt, and therefore, it invites the occurrence of image defects.

Similarly, such members as a photosensitive drum and an intermediary transferring member deteriorate with the elapse of time, affecting sometimes the width of the primary transfer nip between the photosensitive drum and intermediary transfer belt, in terms of the rotational direction of the photosensitive drum. If the primary transfer nip changes in width, the primary transfer bias (voltage) which is optimally set to be applied to the primary transferring member to transfer the toner image onto the belt when these members are brand-new, becomes improper to desirably transfer the toner image onto the belt, inviting therefore the formation of unsatisfactory images.

Similarly, such members as a photosensitive drum and a development roller deteriorate with the elapse of time, affecting sometimes the width of the development nip between the photosensitive drum and development roller, in terms of the rotational direction of the photosensitive drum. If the development nip changes in width, the development bias (voltage) which is optimally set to develop the latent image with the use of toner when these members are brand-new, becomes improper to desirably develop the latent image, inviting therefore the formation of unsatisfactory images.

Thus, the primary object of the present invention is to provided an image forming apparatus which is capable of preventing the occurrence of image defects attributable to the changes in the width of the fixation nip of its fixing portion.

Another object of the present invention is to provide an image forming apparatus which is capable of preventing the occurrence of the image defects attributable to the changes in the width of the secondary transfer nip of its image forming portion.

Another object of the present invention is to provide an image forming apparatus which is capable of preventing the occurrence of image defects attributable to the change in the width of the primary transfer nip of its image forming portion.

Another object of the present invention is provide an image forming apparatus which is capable of preventing the occurrence of the image defects attributable to the change in the width of the development nip of its image forming portion.

SUMMARY OF THE INVENTION

According to an aspect of the present invention, there is provided an forming apparatus comprising an image forming portion for forming an unfixed toner image on a recording material; a fixing portion including a fixing rotatable member, a heating member configured to heat said fixing rotatable member, a pressing rotatable member cooperating with said fixing rotatable member to form a fixing nip to fix the toner image on the recording material by heating the recording material carrying the toner image while nipping and feeding the recording material by the fixing nip; an image reader; and a controller configured to set a temperature condition for said heating member, wherein said image forming apparatus forms a toner image pattern for measuring a width of the nip, on the recording material by said image forming portion, fixes the toner image pattern on the recording material by heating the recording material while nipping and feeding the recording material by the fixing nip, and refeeds the recording material through the fixing nip, during which rotations of said fixing rotatable member and said pressing rotatable member are stopped to provide a trace of the fixing nip and the fixed toner image pattern, wherein said image reader reads a width of the nip trace in a recording material feeding direction, and wherein said controller changes the temperature condition in response to a result of the nip width read by said image reader.

According to another aspect of the present invention, there is provided an image forming apparatus comprising an image forming portion configured to form an unfixed toner image and a recording material, said image forming portion including a rotatable image bearing member, a first transfer member, a rotatable feeding member cooperating with said image bearing member to form a first transfer nip and configured to feed the recording material carrying the toner image transferred from said image bearing member by said first transfer member, and a second transfer member cooperating with said feeding member to form a second transfer nip and configured to meet and feed the recording material and said feeding member to transfer the toner image from said feeding member onto the recording material; a fixing portion configured to fix the toner image on the recording material; an image reader; and a controller configured to set an image forming condition of said image forming portion, wherein said image forming apparatus transfers a toner image pattern for measuring a width of the nip from said image bearing member onto the recording material by said first transfer member at the first transfer nip, wherein during the second transfer nip feeding the recording material, rotation of said feeding member is stopped, and transfer operation of the toner image pattern by said second transfer member is stopped, and then the transfer operation of said toner image pattern is carried out, so that a trace of the nip of the second transfer nip is formed on the recording material, wherein said fixing portion fixes the trace on the recording material, and wherein said image reader reads a width of the nip trace toner image in a recording material feeding direction, and wherein said controller controls the image forming condition in accordance with a different between results of reading of the nip trace toner image at an end portion and a central portion of the nip trace toner image with respect to a direction perpendicular to the recording material feeding direction.

According to a further aspect of the present invention, there is provided an image forming apparatus comprising an image forming portion configured to form an unfixed toner image and a recording material, said image forming portion including a rotatable image bearing member, a first transfer member, a rotatable feeding member cooperating with said image bearing member to form a first transfer nip and configured to feed the recording material carrying the toner image transferred from said image bearing member by said first transfer member, and a second transfer member cooperating with said feeding member to form a second transfer nip and configured to meet and feed the recording material and said feeding member to transfer the toner image from said feeding member onto the recording material; a fixing portion configured to fix the toner image on the recording material; an image reader; and a controller configured to set an image forming condition of said image forming portion, wherein during transferring a toner image pattern for measuring a width of the nip, from said image bearing member onto said feeding member at the first transfer nip, said image forming apparatus stops rotation of said feeding member and a transfer operation of the toner image pattern by the first transfer member, and then carries out the transfer operation of the toner image pattern, so that a trace of the nip of the first transfer nip is formed on said feeding member, wherein said image reader reads a width of the nip trace toner image in a peripheral movement direction of said feeding member, and wherein said controller changes the image forming condition in accordance with a result of reading of the width by said image reader.

According to a further aspect of the present invention, there is provided an image forming apparatus comprising an image forming portion configured to form an unfixed toner image and a recording material, said image forming portion including a rotatable image bearing member, an exposure means configured to form a latent image on said image bearing member, a developing member cooperating with said image bearing member to form a development nip in which the latent image is developed with toner, a first transfer member, a rotatable feeding member cooperating with said image bearing member to form a first transfer nip and configured to feed the recording material carrying the toner image transferred from said image bearing member by said first transfer member, and a second transfer member cooperating with said feeding member to form a second transfer nip and configured to meet and feed the recording material and said feeding member to transfer the toner image from said feeding member onto the recording material; a fixing portion configured to fix the toner image on the recording material; an image reader; and a controller configured to set an image forming condition of said image forming portion, wherein said image forming apparatus forms a latent image for measuring a width of the development nip on said image bearing member by said exposure means, wherein during developing the latent image with the toner by said developing member, rotation of said image bearing member is stopped for a predetermined period of time, and developing operation of the latent image by said developing member is stopped, and then the developing operation of the latent image is carried out to form a trace of the development nip on said image bearing member, transfers the nip trace toner image from said image bearing member onto the feeding member by said first transfer member, wherein said image reader reads a width of the nip trace toner image in a peripheral movement direction of said feeding member, and wherein said controller changes the image forming condition in accordance with a result of reading of the width by said image reader.

Further features of the present invention will become apparent from the following description of exemplary embodiments with reference to the attached drawings.

Figure 4:
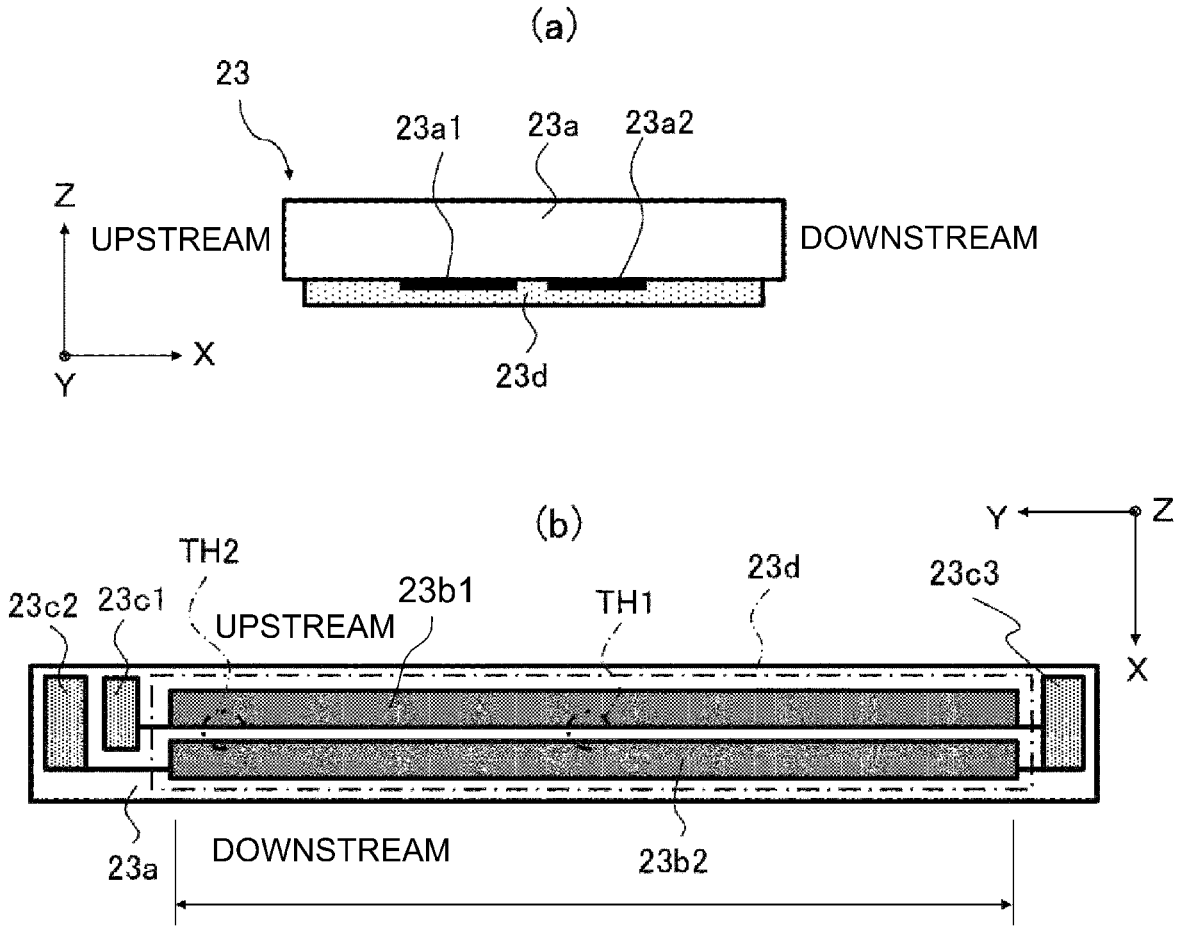

Parts (a) and (b) of FIG. 4 are a combination of a schematic sectional view (a) of the heater at a vertical plane which is parallel to the moving direction of the film, and a schematic top view (b) of the heater; it is for showing the general structure of the heater.

Figure 5:
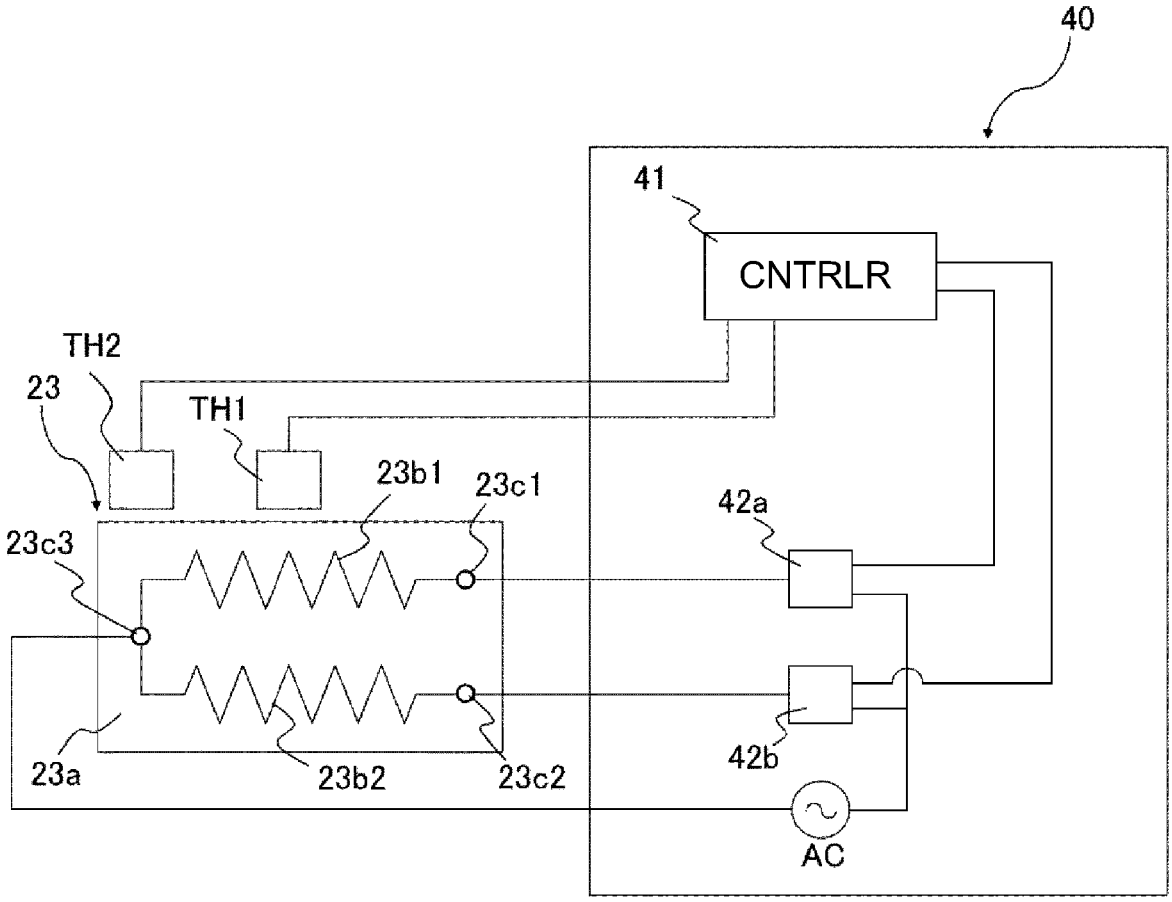

FIG. 5 is a circuit diagram of a combination of a heater and a heat driving circuit.

Figure 6:
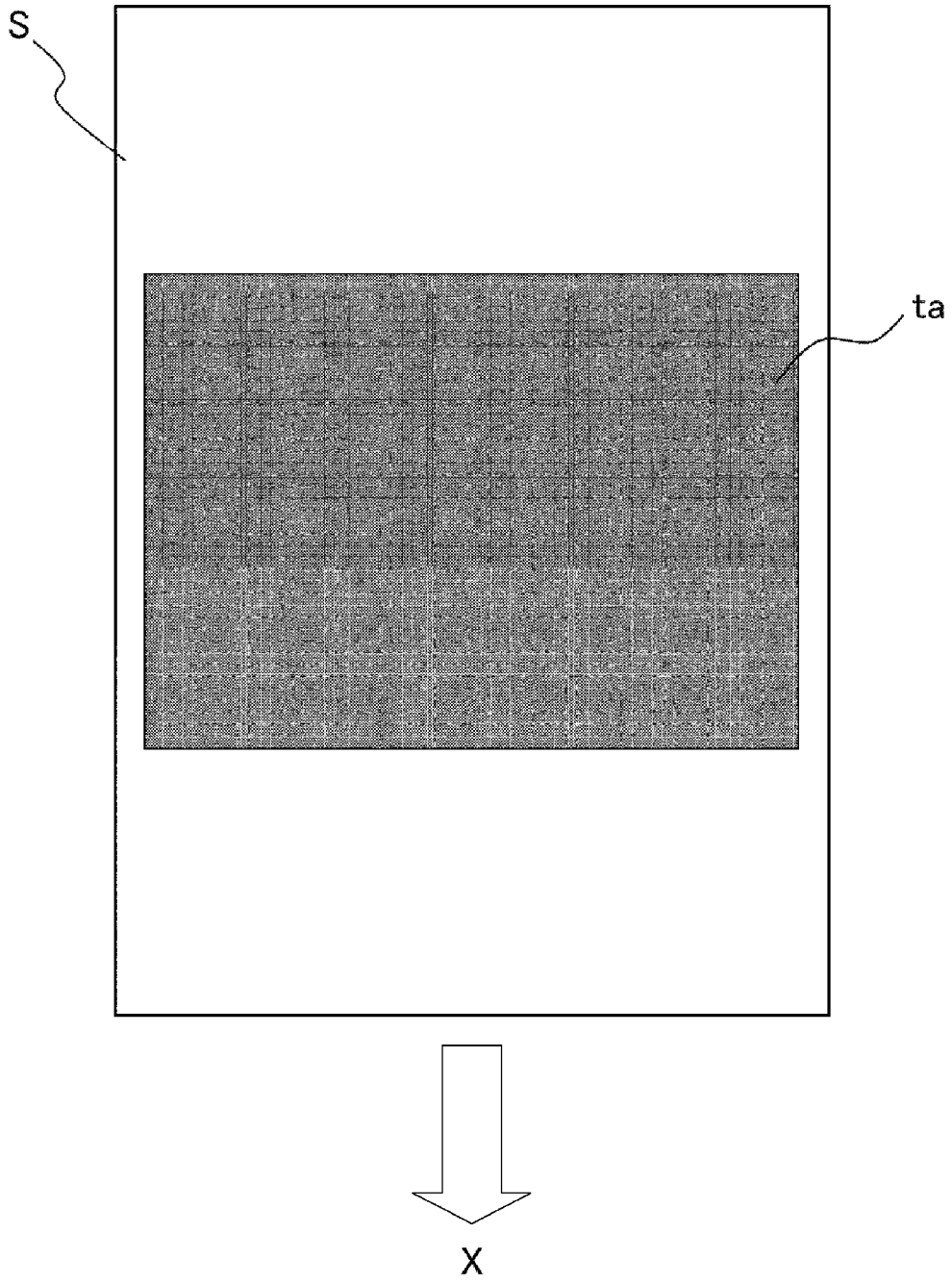

FIG. 6 is a drawing for showing the pattern of the image borne on a sheet of recording medium.

Figure 7:
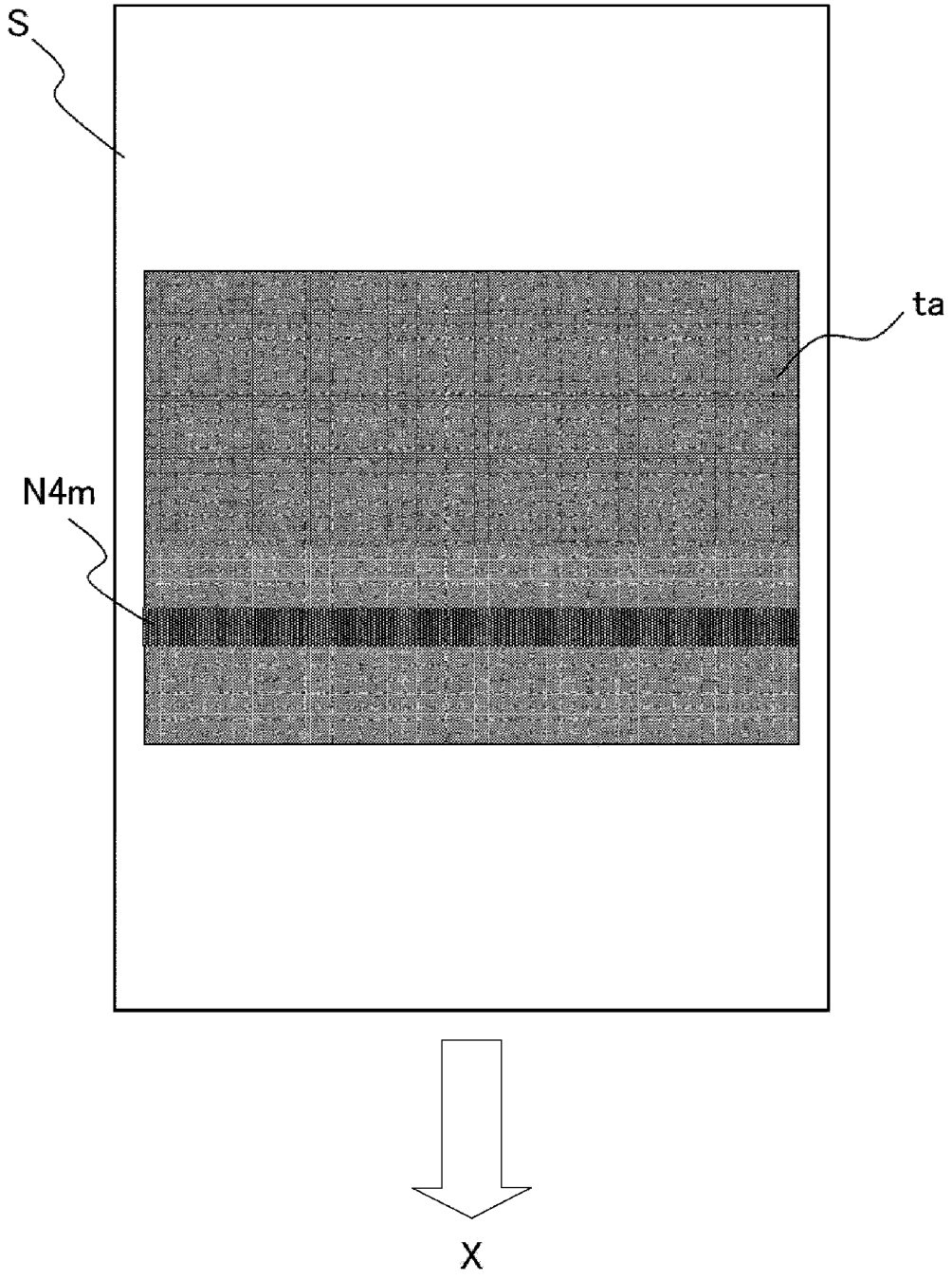

FIG. 7 is a drawing of the nip image formed across the image shown in FIG. 6.

Figure 8:
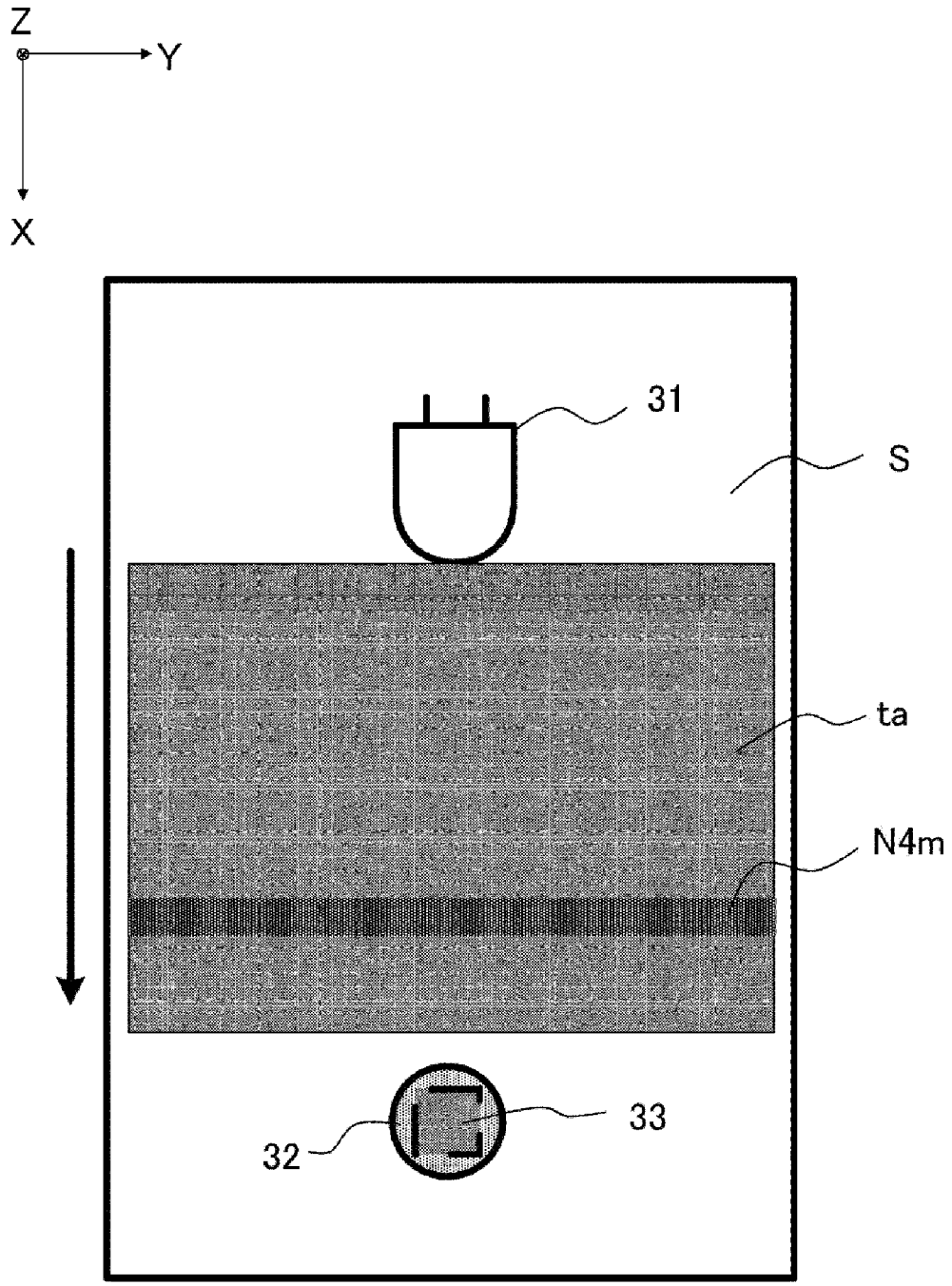

FIG. 8 is a drawing of a combination of an LED, a line sensor, and a focal lens of the image reading apparatus, as seen from the image bearing side of a sheet of recording medium.

Figure 9:
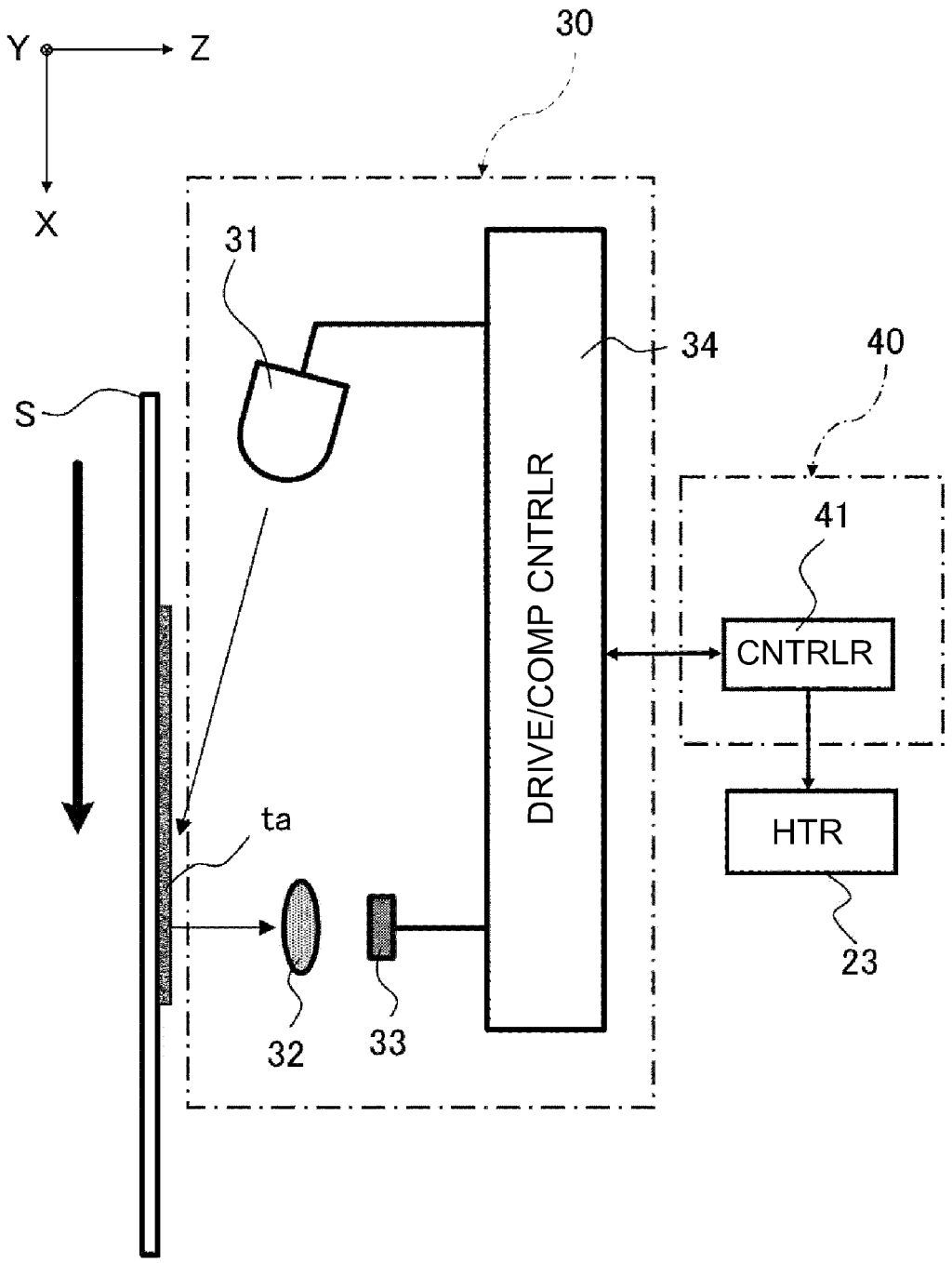

FIG. 9 is a block diagram of a combination of the image reading apparatus, heater driving circuit, and heater; it shows the relationship among the image reading apparatus, heater driving circuit, and heater.

Figure 10:
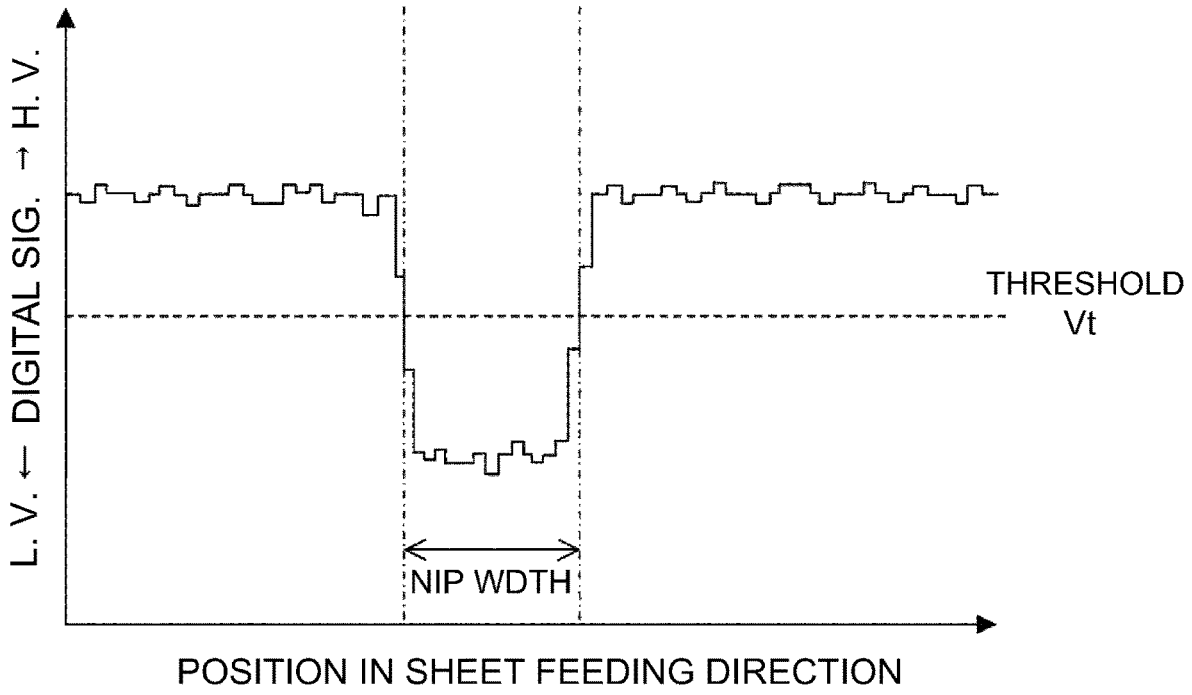

FIG. 10 is a drawing (graph) which shows the relationship between the voltage of the digital signals outputted by the line sensor, and the position of the light sensing element of the line sensor in terms of the recording medium conveyance direction.

Figure 11:
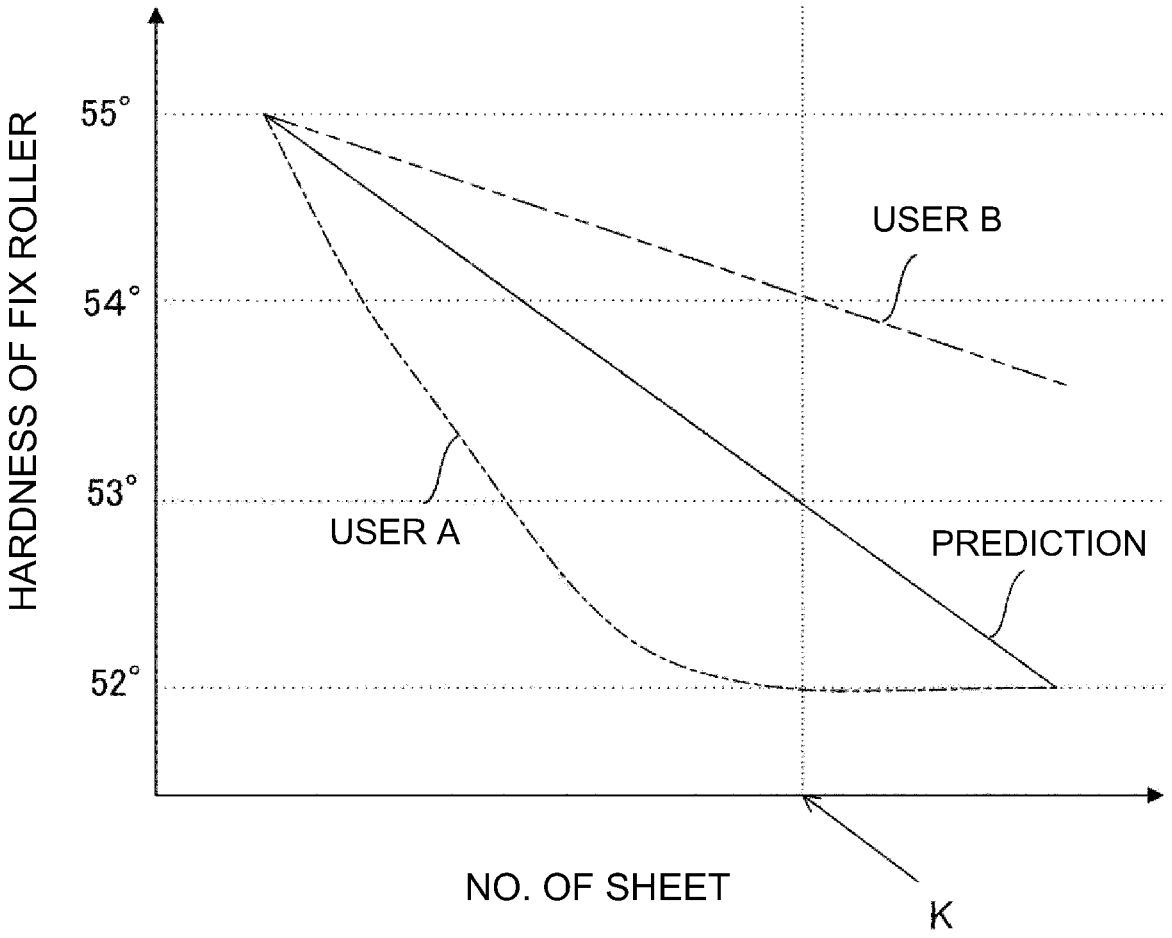

FIG. 11 is a drawing (graph) which shows the relationship between the hardness of the pressure roller and the cumulative number of sheets of recording medium conveyed through the fixation nip.

Figure 12:
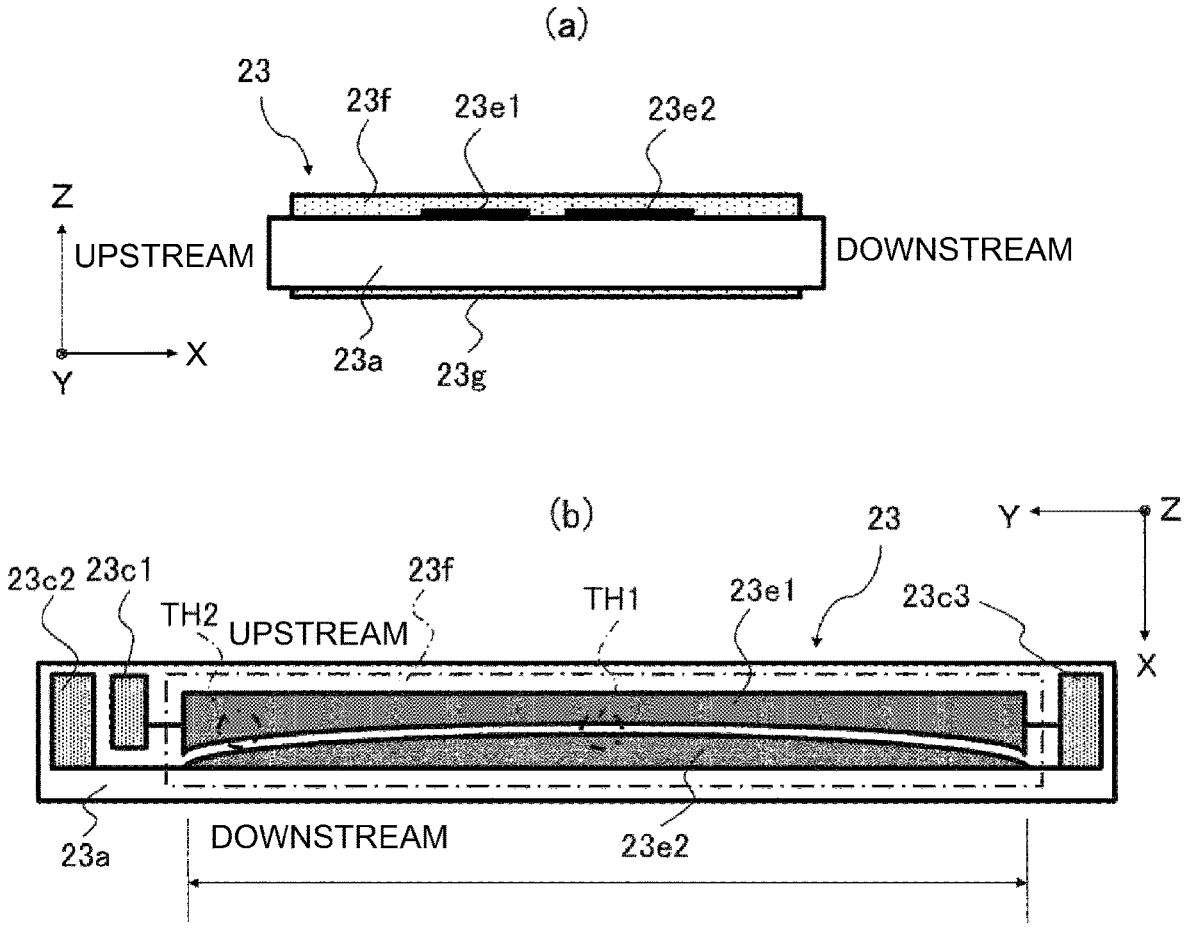

Parts (a) and (b) of FIG. 12 are a combination of cross-sectional and top views of the heater of the fixing apparatus of the image forming apparatus in the second embodiment of the present invention; it shows the general structure of the heater.

Figure 13:
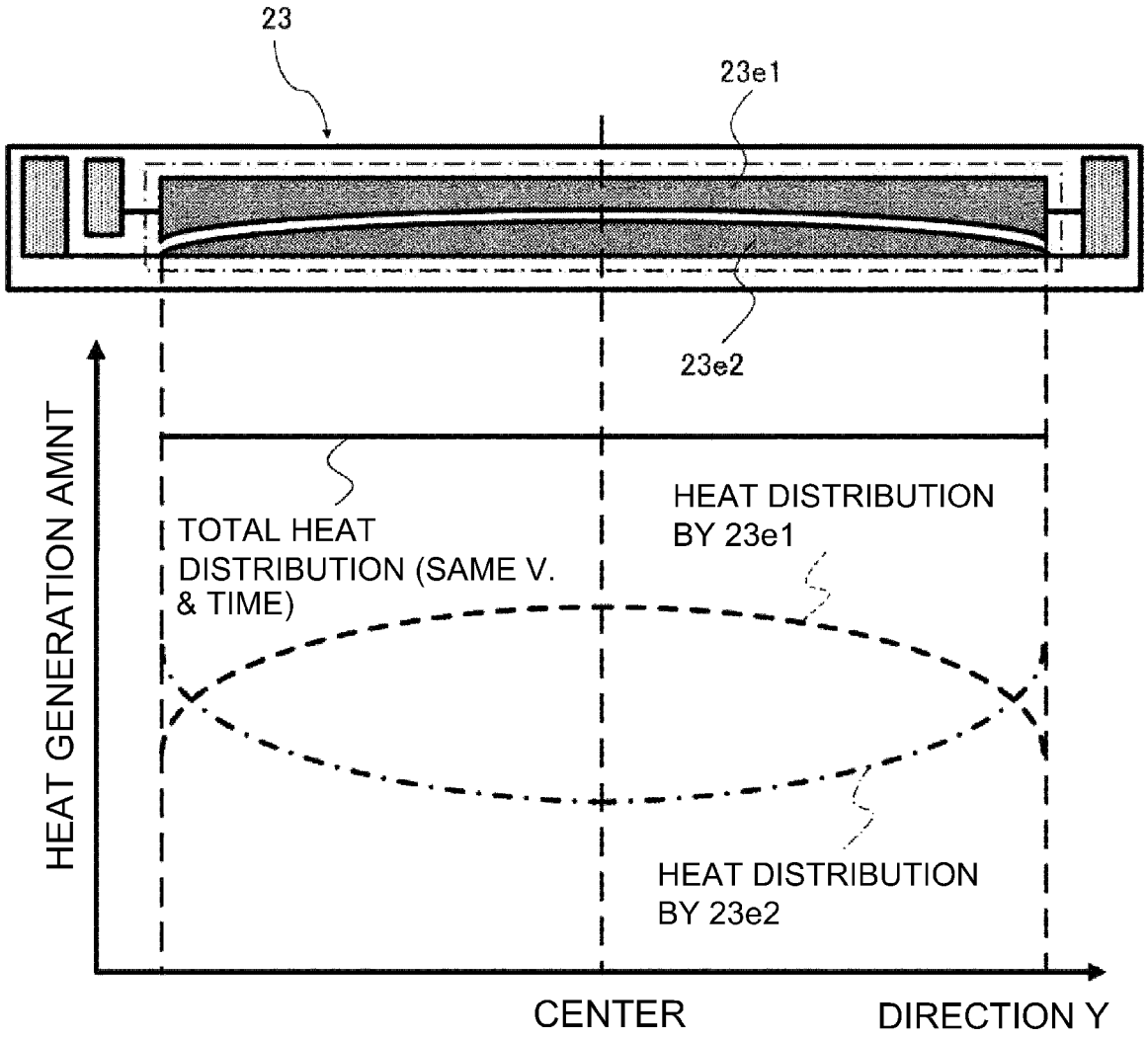

FIG. 13 is a drawing for showing the pattern of heat generation of each of two heat generating across the heating range, in terms of the direction perpendicular to the recording medium conveyance direction, and the pattern of heat generation of a combination of the two heaters, across the heating range.

Figure 14:
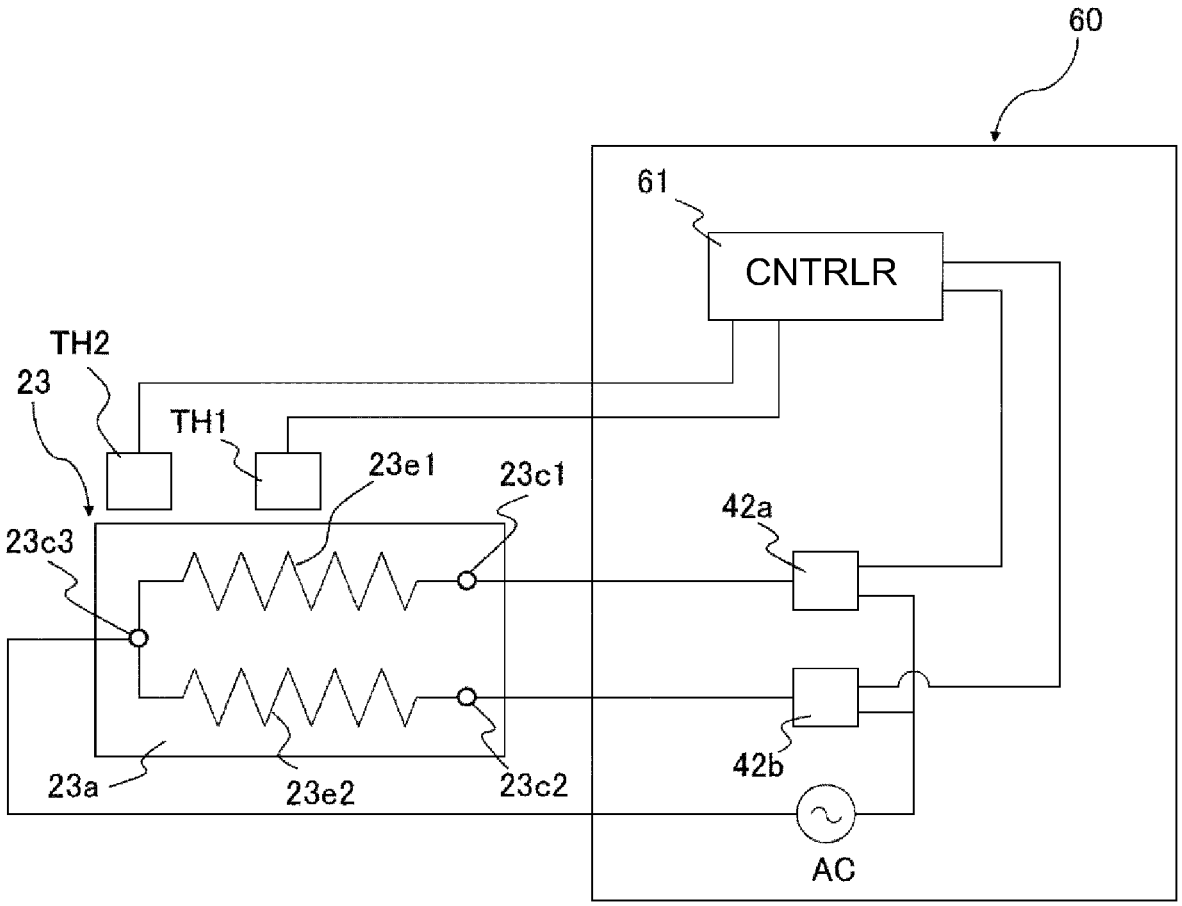

FIG. 14 is a combination of the heater driving circuit, and heater circuit which is a part of the heater driving circuit.

Figure 15:
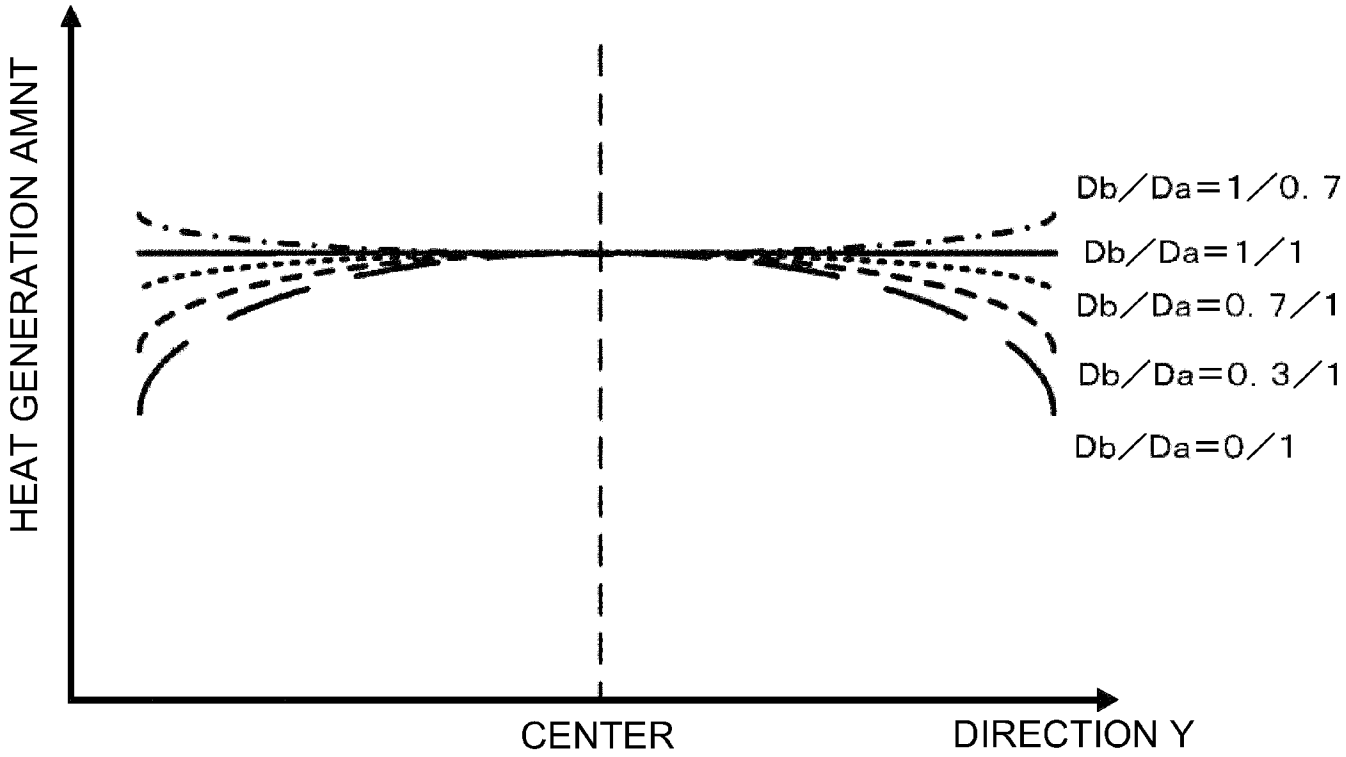

FIG. 15 is a drawing (graph) for showing the relationship between the duty ratio of the electrical power supplied to the heater, and the pattern of heat generation of the heater, in terms of the lengthwise direction of the heater.

Figure 16:
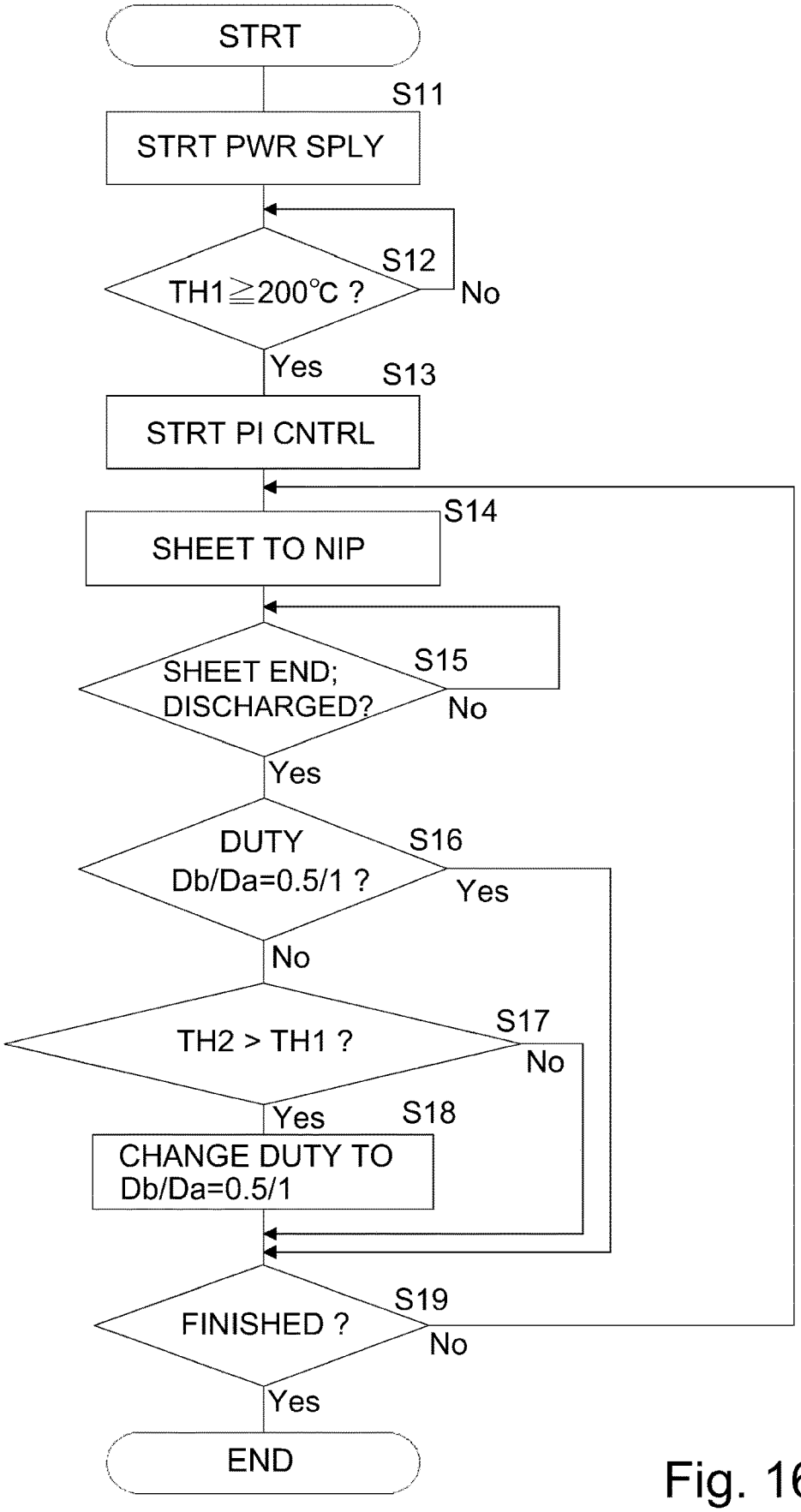

FIG. 16 is a flowchart of the heater driving sequence.

Figure 17:
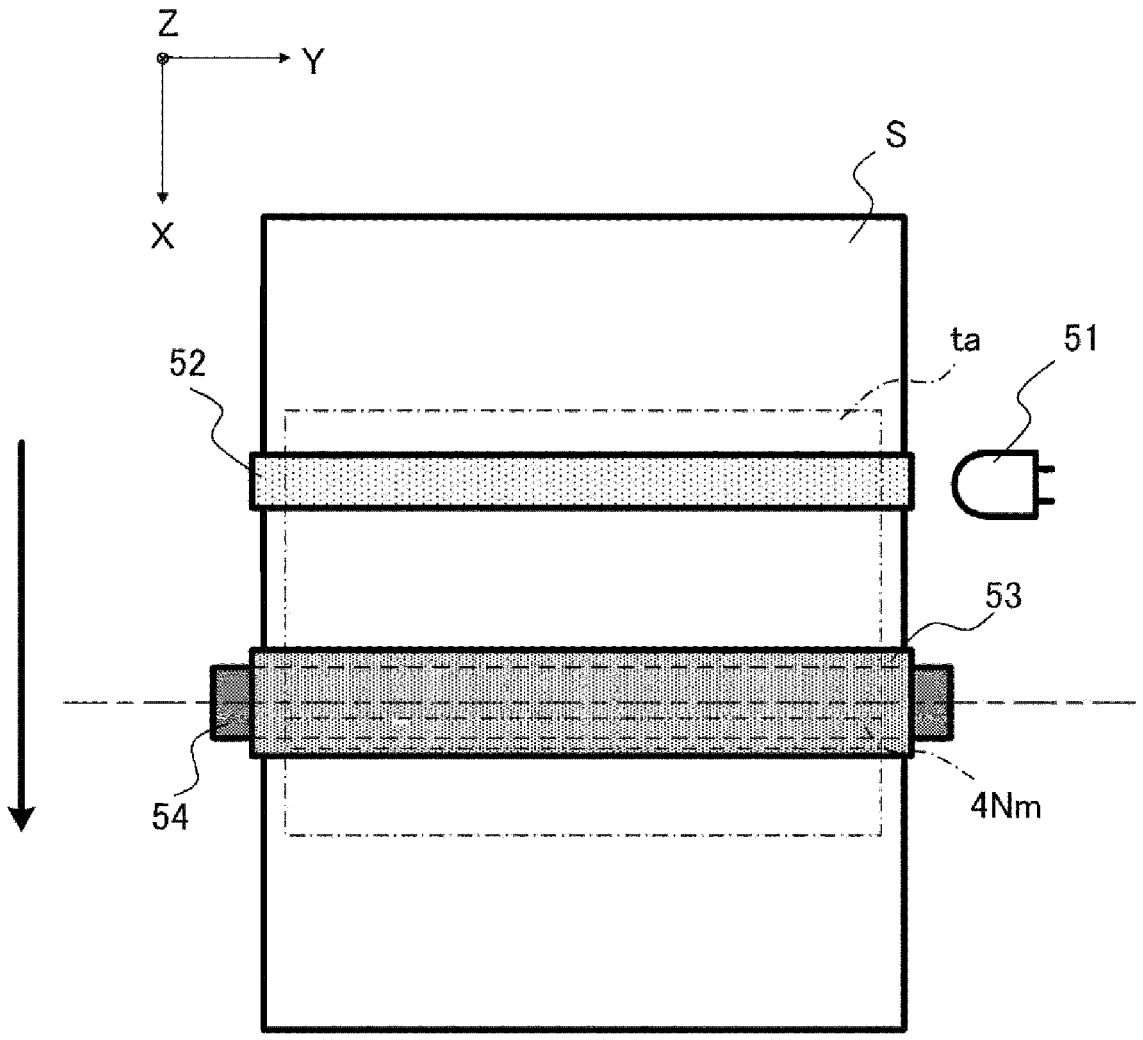

FIG. 17 is a drawing of a combination of the LED, light guiding member, line sensor, and focal lens of the image reading apparatus, as seen from the image bearing side of a sheet of recording medium.

Figure 18:
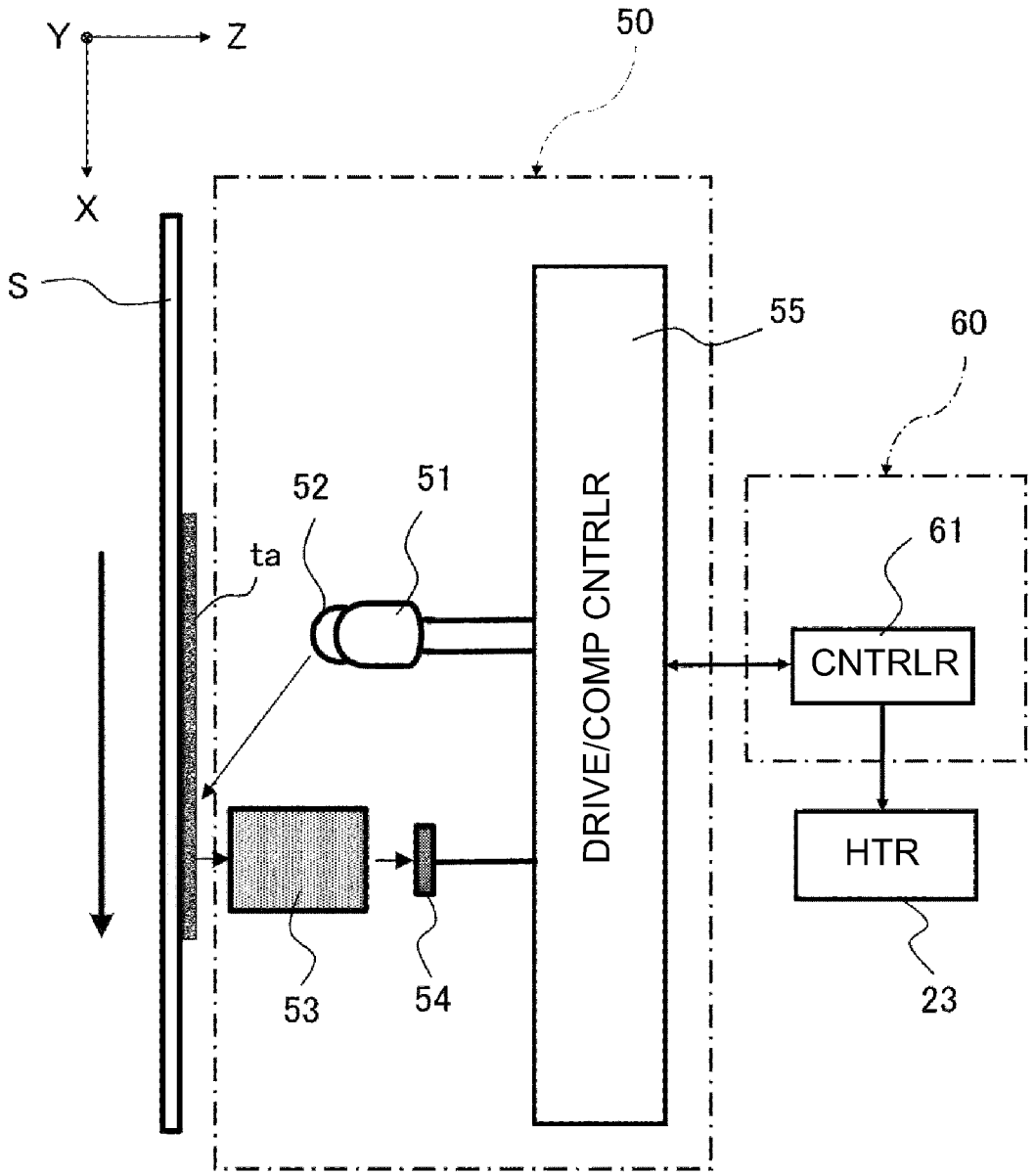

FIG. 18 is a block diagram of a combination of image reading apparatus, heater driving circuit, and heater; it is for showing the relationship among them.

Figure 19:
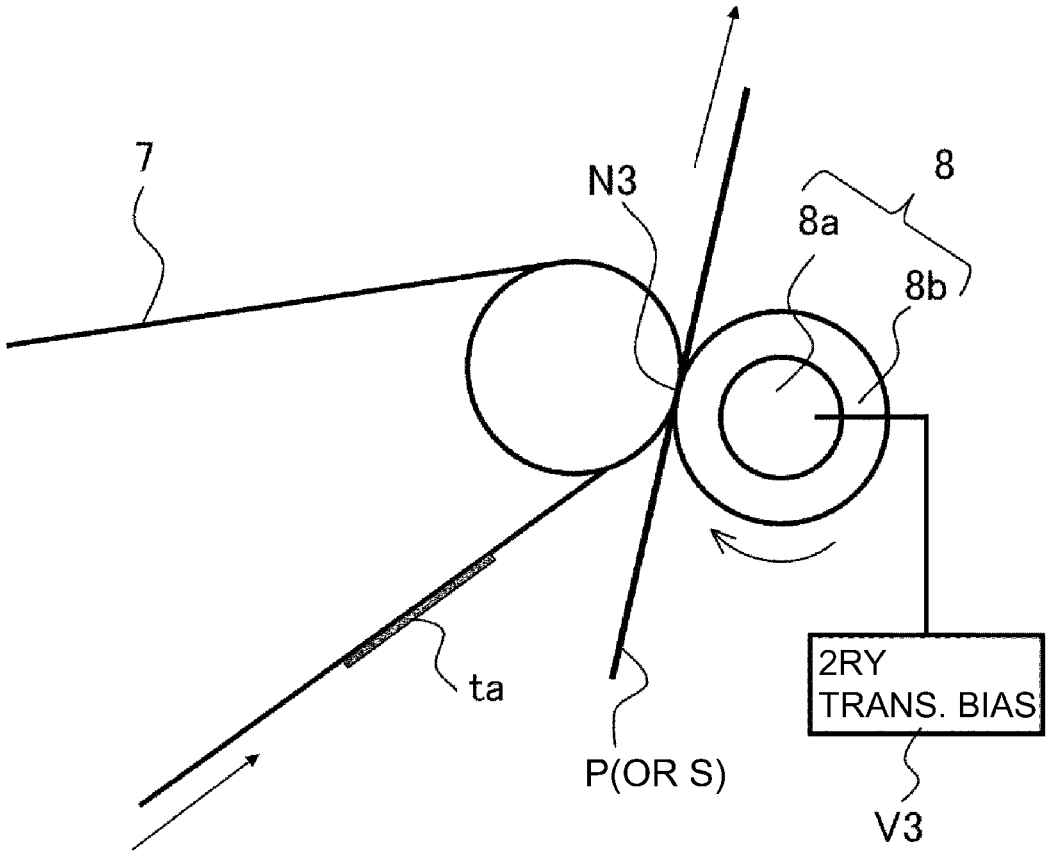

FIG. 19 is a sectional view of a combination of the belt and secondary transferring member of the image forming apparatus in the third embodiment of the present invention, which form the secondary transfer nip.

Figure 20:
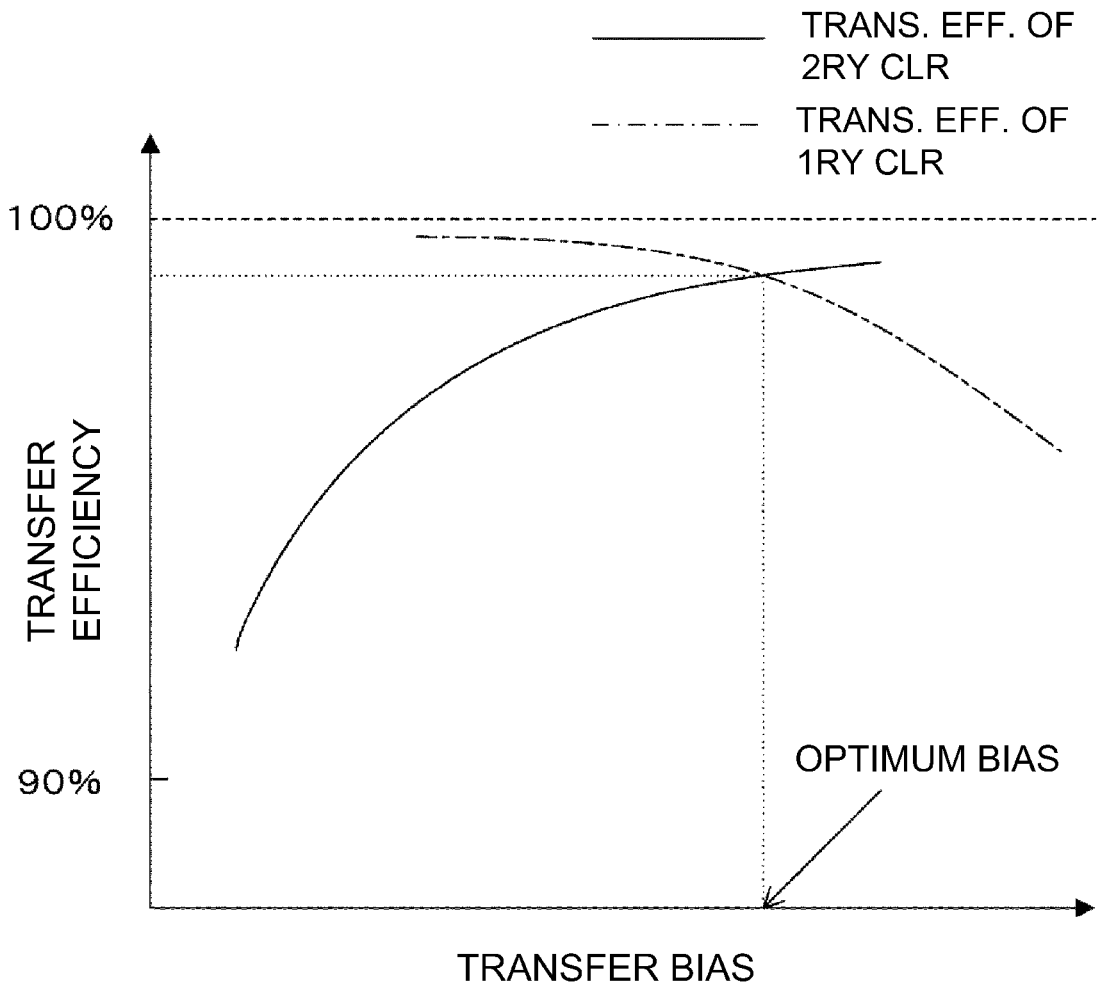

FIG. 20 is a drawing (graph) which shows the relationship between the secondary transfer bias and the secondary transfer efficiency.

Figure 21:
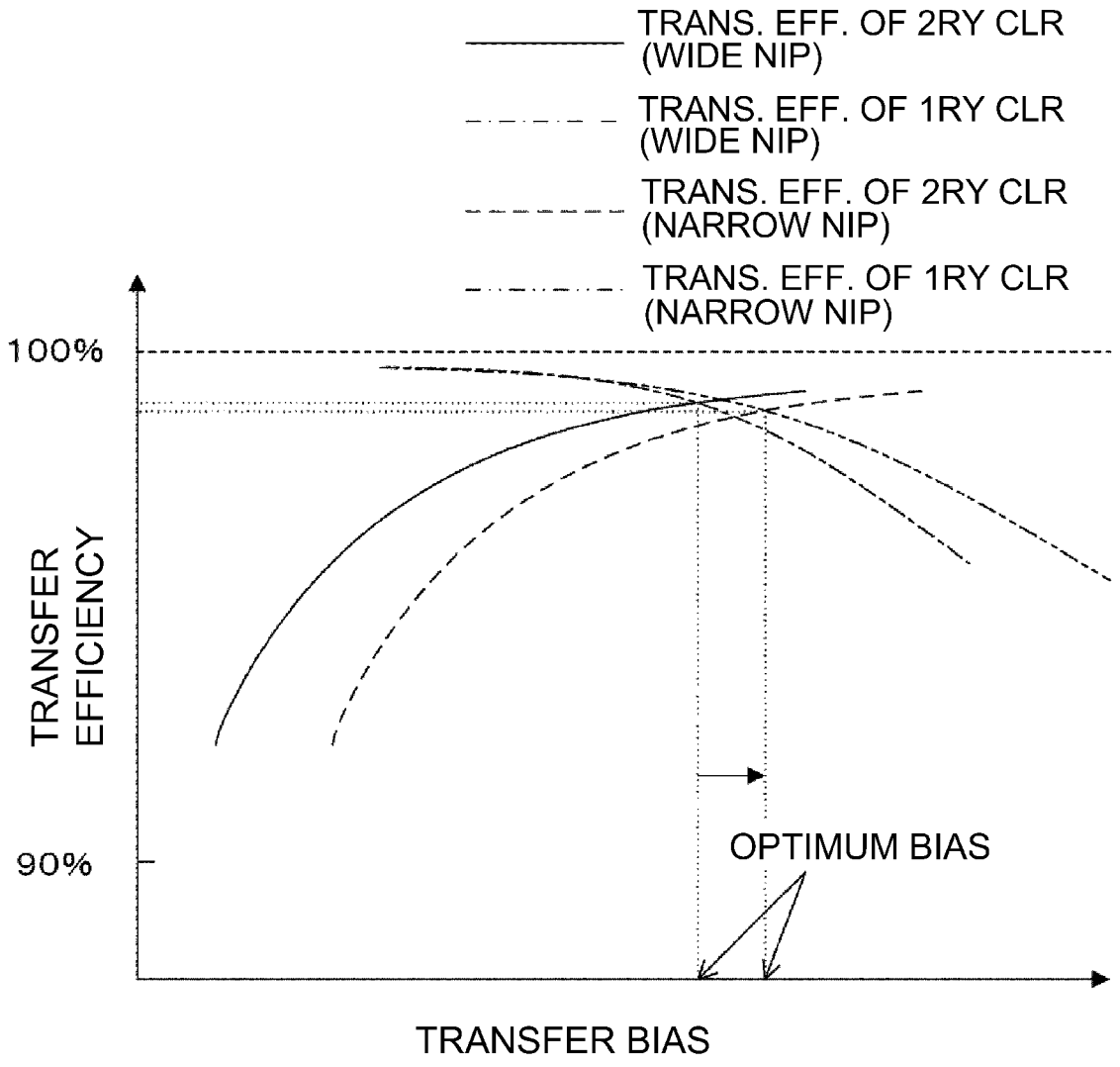

FIG. 21 is a combination of FIG. 20, and a drawing (graph) which shows the relationship between the secondary transfer bias and secondary transfer efficiency after the narrowing of the secondary transfer nip, and which was layered upon FIG. 20.

Figure 22:
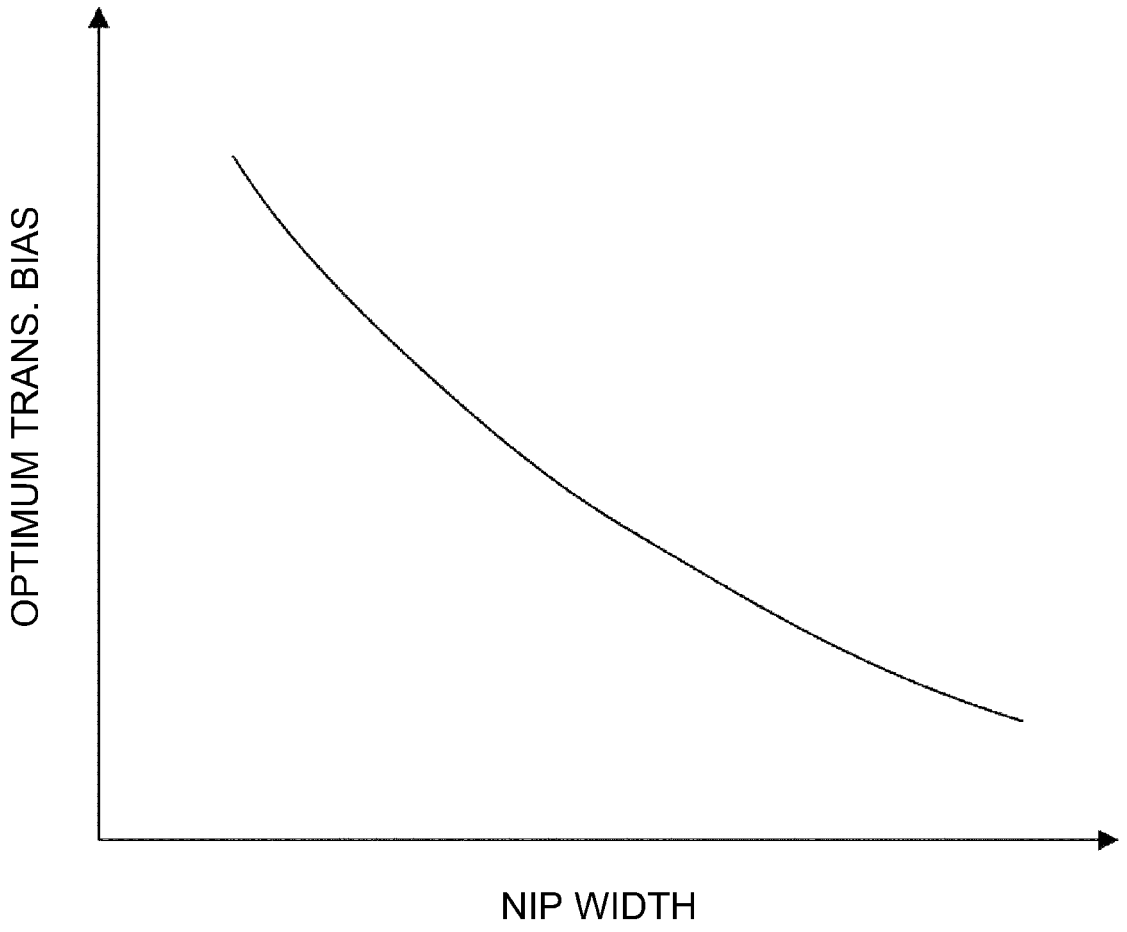

FIG. 22 is a drawing (graph) which shows the relationship between the width of the secondary transfer nip and the optimal secondary transfer bias.

Figure 23:
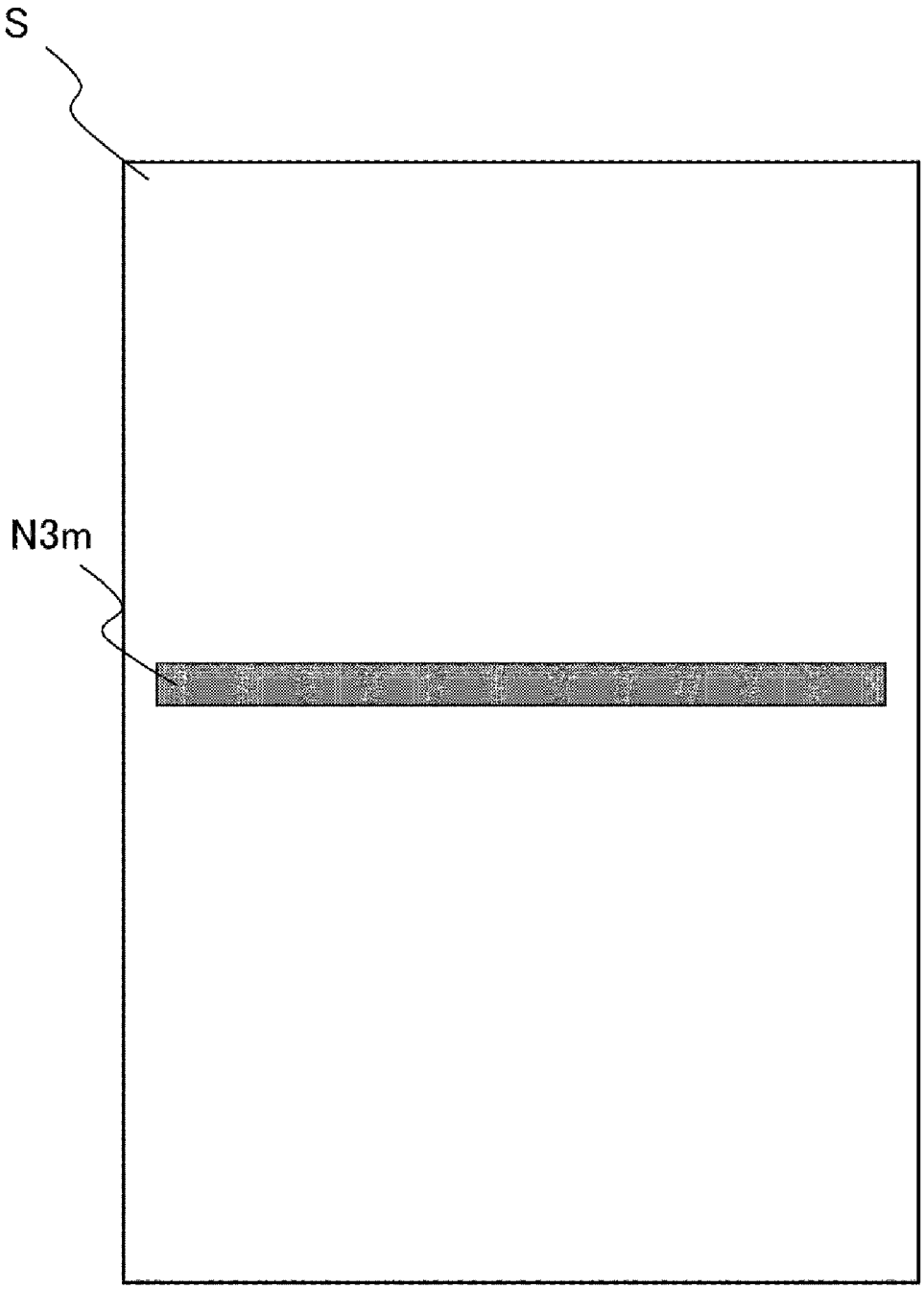

FIG. 23 is a drawing of a sheet of recording medium having an image of the secondary transfer nip.

Figure 24:
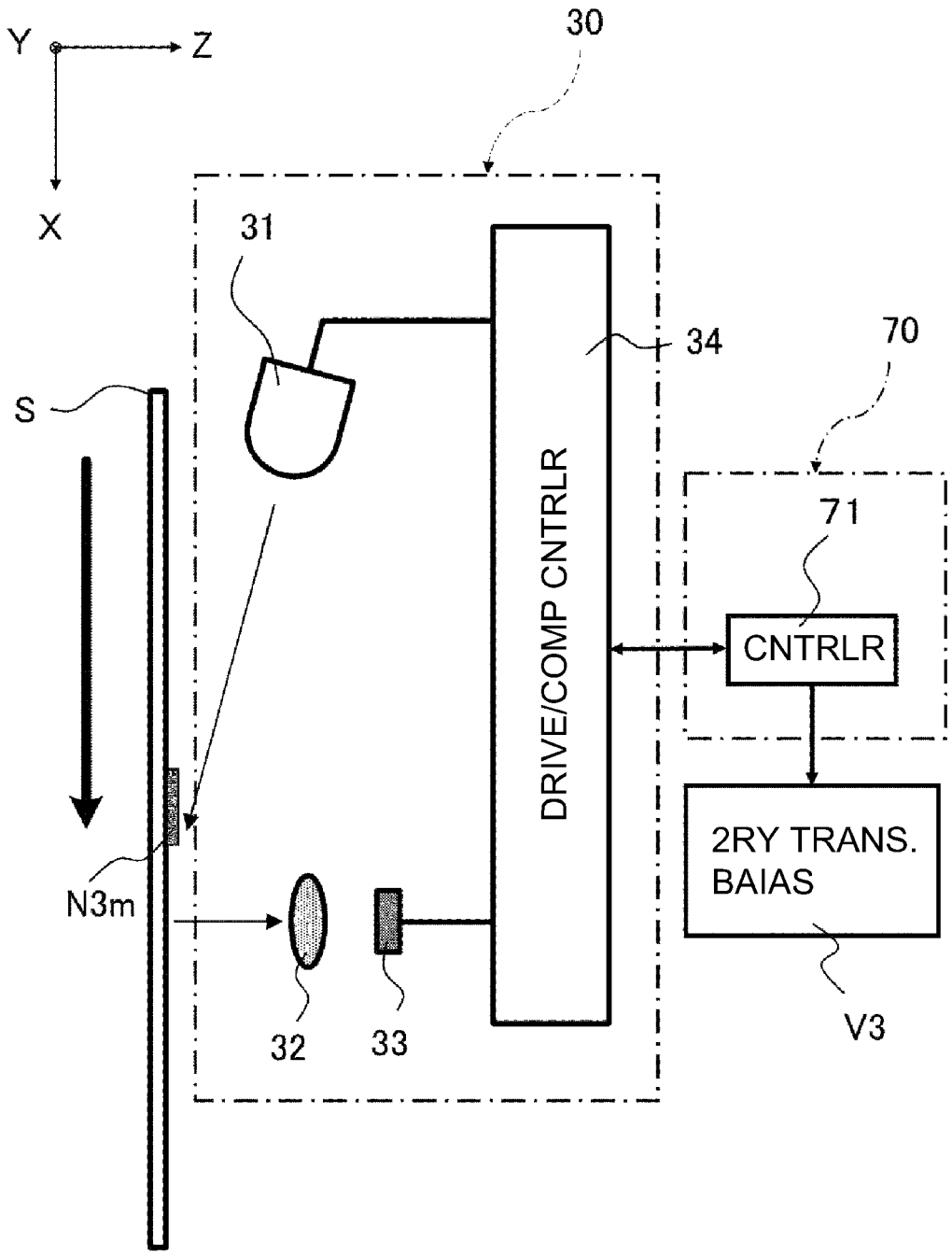

FIG. 24 is a block diagram of a combination of the image reading apparatus, power source driving circuit, and secondary transfer bias power source; it is for showing the relationship among these portions.

Figure 25:
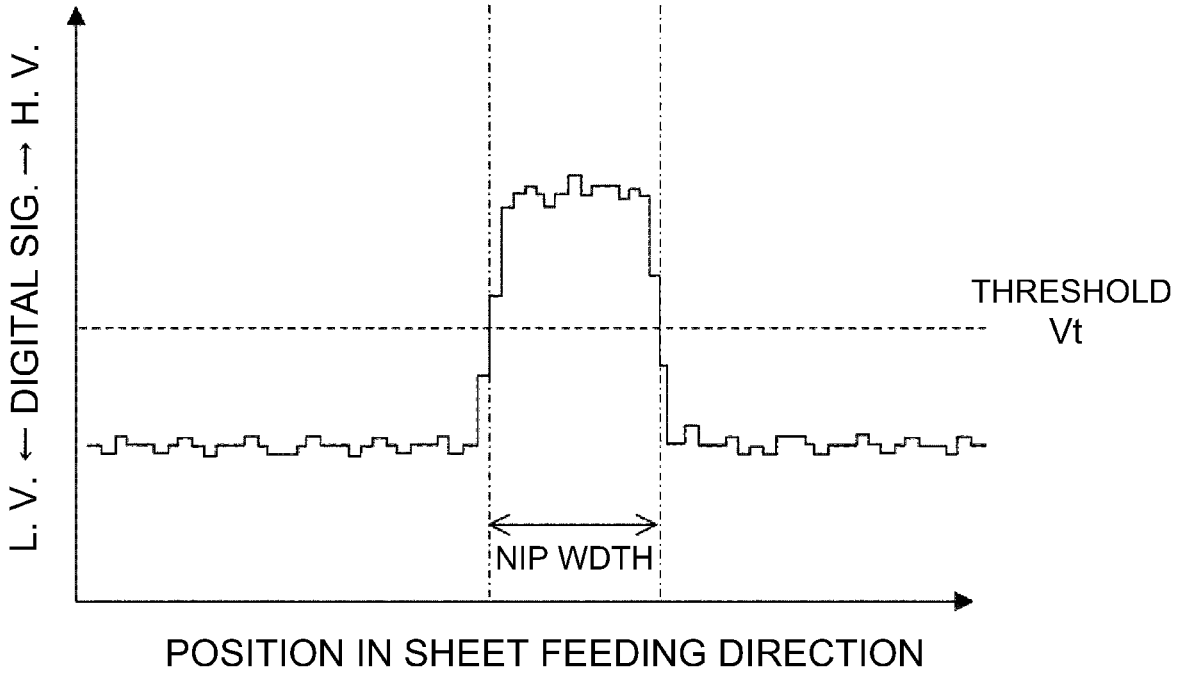

FIG. 25 is a drawing which shows the output of the line sensor.

Figure 26:
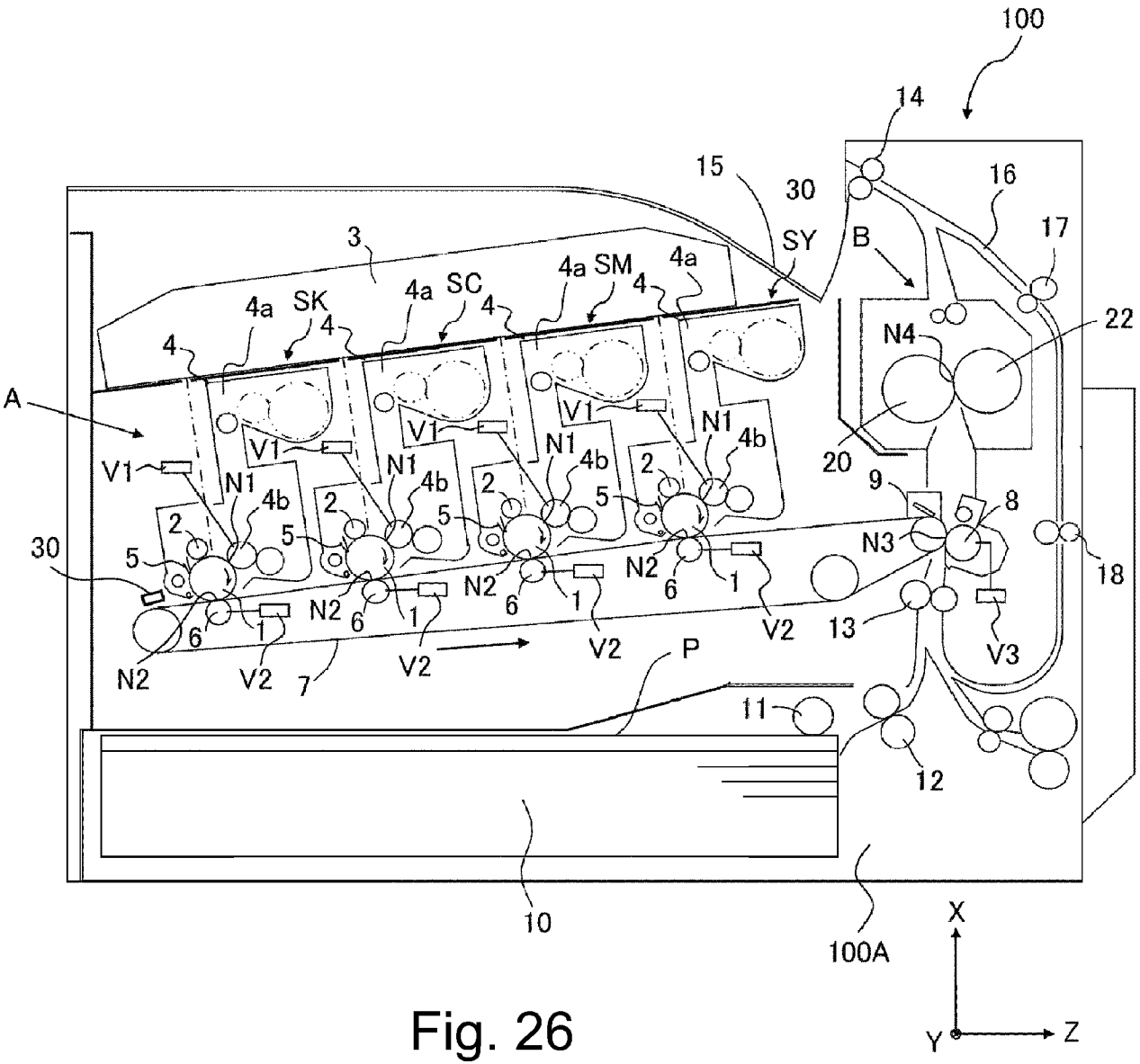

FIG. 26 is a schematic sectional view of the image forming apparatus in the fourth embodiment of the present invention; it is for showing the general structure of the apparatus.

Figure 27:
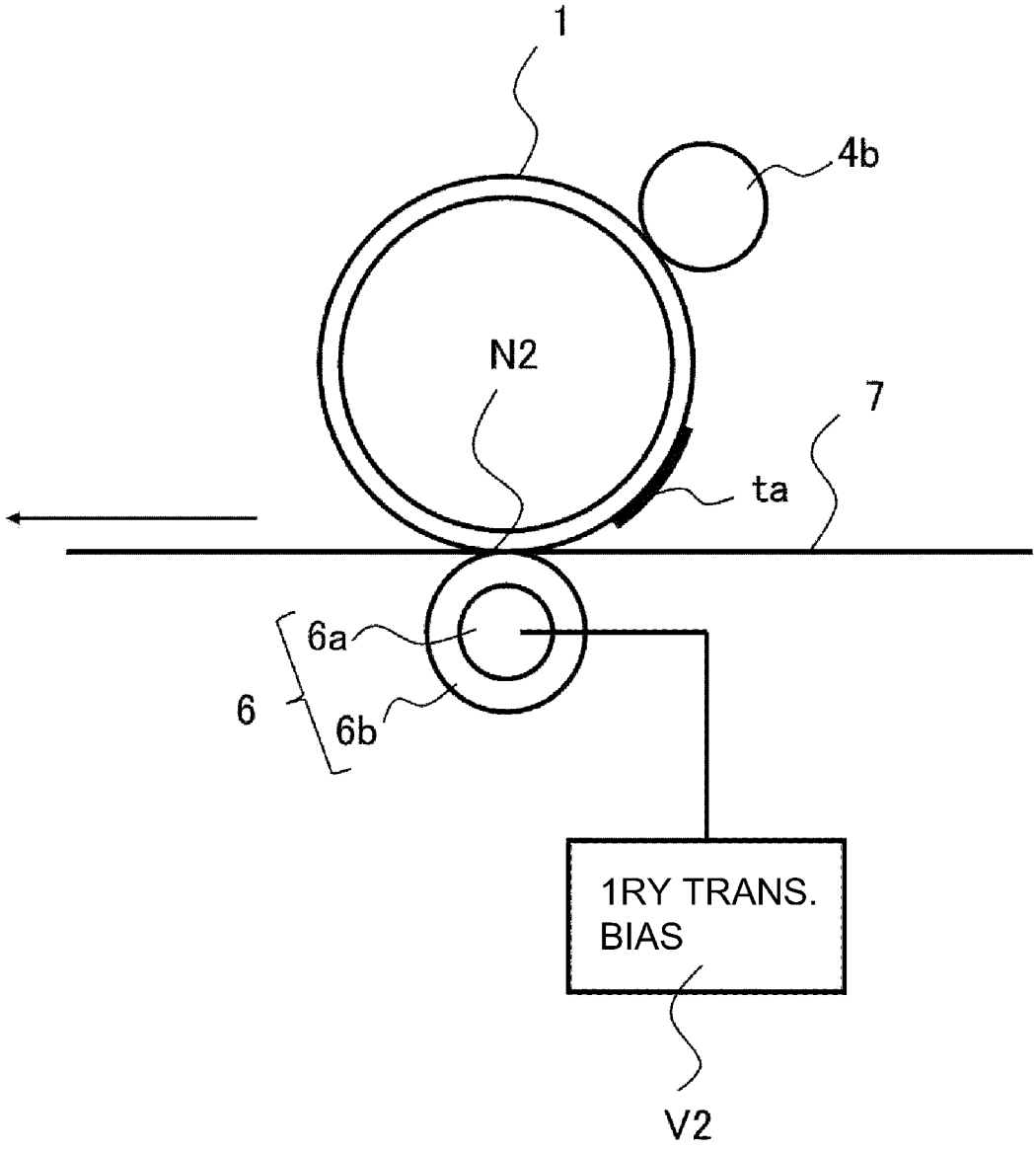

FIG. 27 is sectional view of a combination of the development roller, belt which forms the secondary transfer nip, in coordination with the development roller, photosensitive drum, and secondary transfer roller.

Figure 28:
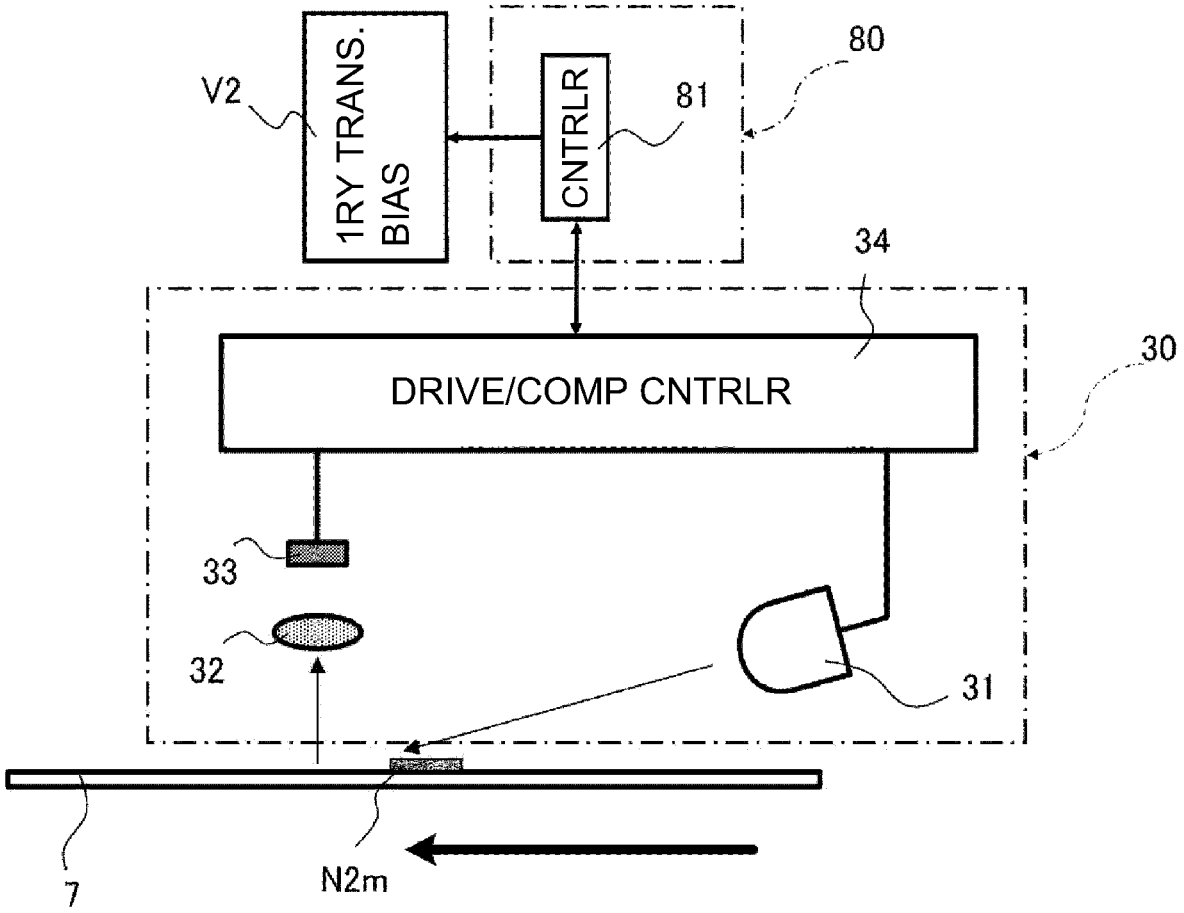

FIG. 28 is a block diagram of a combination of the image reading apparatus, power source driving circuit, and primary transfer bias power source of the image forming apparatus; it is for showing the relationship among these portions of the image forming apparatus.

Figure 29:
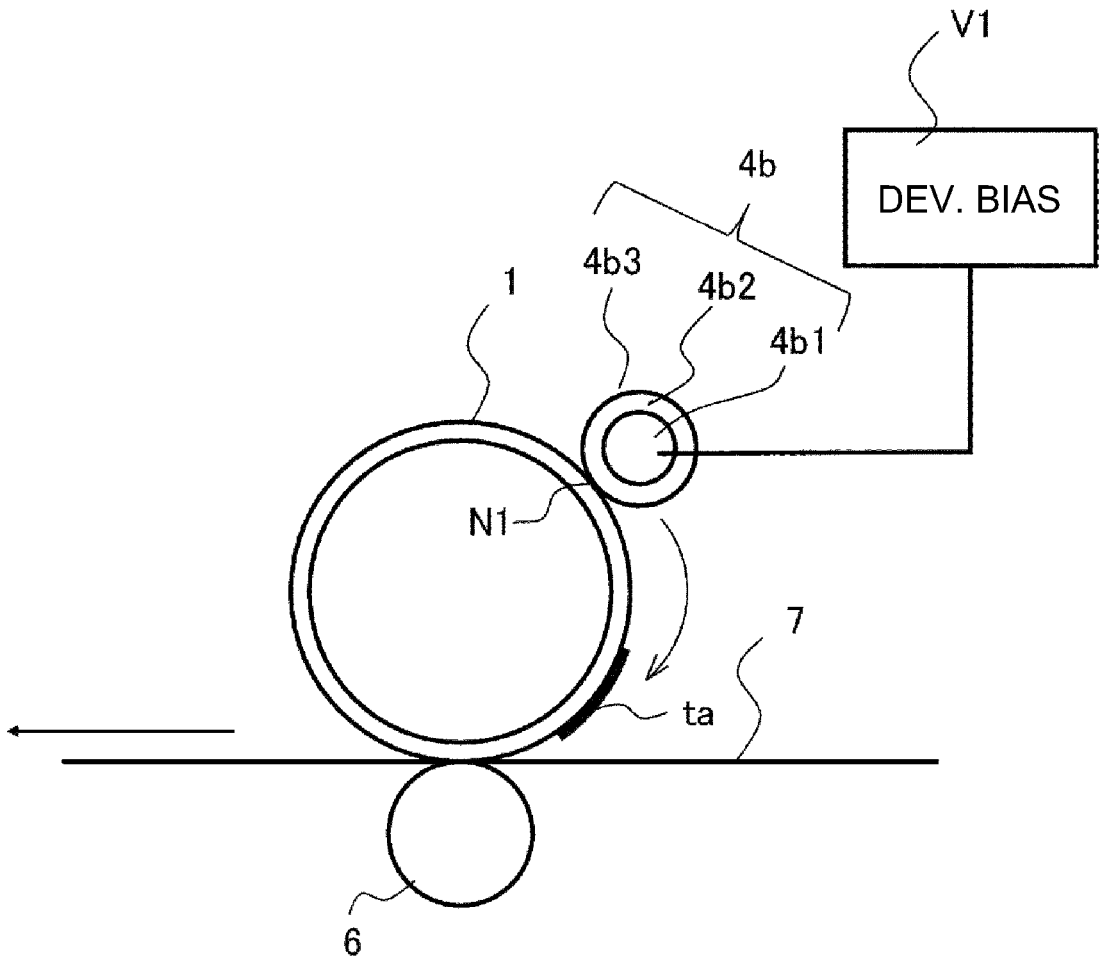

FIG. 29 is a schematic sectional view of a combination of the development roller, photosensitive drum, belt, and secondary transfer roller of the image forming apparatus in the fifth embodiment of the present invention, which forms the development nip of the image forming apparatus.

Figure 30:
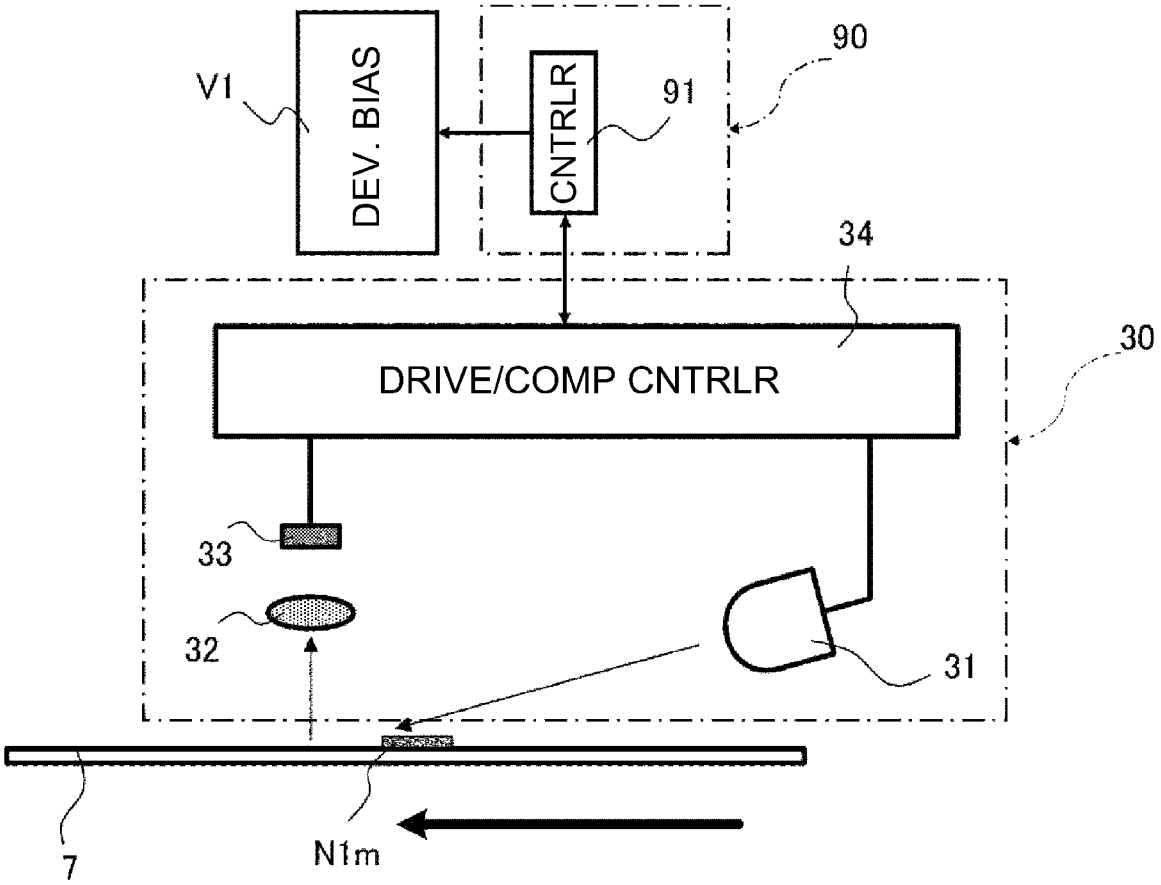

FIG. 30 is a block diagram of a combination of the image reading apparatus, power source driving circuit, and development bias power source of the image forming apparatus in the fifth embodiment; it shows the relationship among these portions of the apparatus.

DESCRIPTION OF THE EMBODIMENTS

Hereafter, a few of the preferred embodiments of the present invention are described with reference to appended drawings. The preferred embodiments of the present invention are examples of embodiments of the present invention and are not intended to limit the present invention in scope. That is, the present invention is applicable to not only those in the preferred embodiments, but also, various other image forming apparatuses which are different in structure from those in the preferred embodiment. Various other image forming apparatuses are within the scope of the present invention.

Embodiment 1

The image forming apparatus in this embodiment changes a temperature setting of a heater of a fixing apparatus, according to the results of reading of an image of the fixation nip. Here, "temperature setting" means the temperature setting for the heater, which is for increasing heater temperature to a preset level (target temperature) and keeping it at the target temperature.

<Image Forming Apparatus 100>

Figure 1:
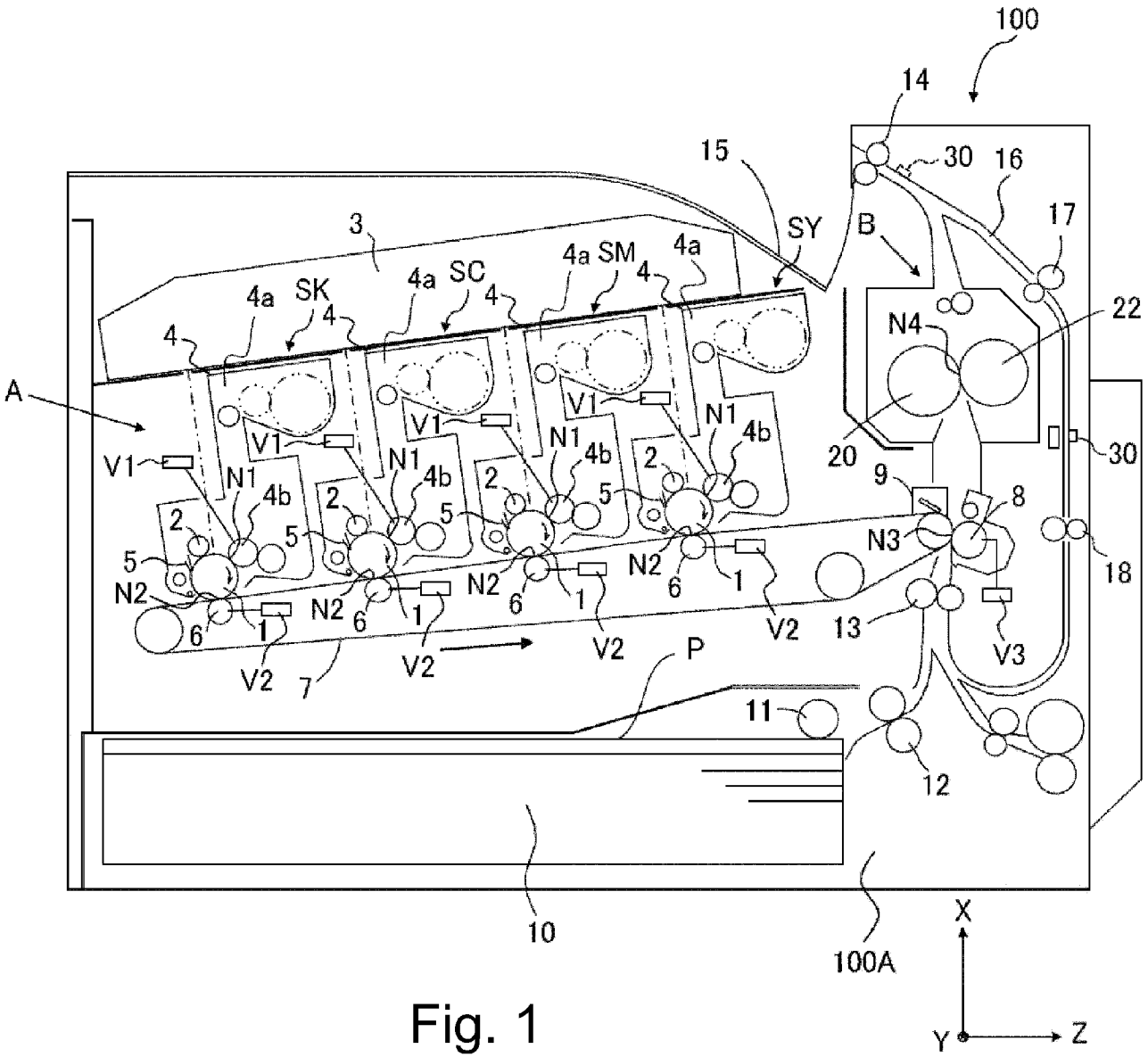
FIG. 1 is a sectional view of the image forming apparatus in the first embodiment of the present invention; it is for showing the general structure of the apparatus.

Referring to FIG. 1, the image forming apparatus 100 in this embodiment is described. FIG. 1 is a schematic sectional view of the image forming apparatus 100 (full-color printer, in this embodiment), which is an example of an image forming apparatus which uses electrophotographic recording technologies. FIG. 1 shows the general structure of the apparatus.

The image forming apparatus 100 has an image forming portion A, and a fixing apparatus B as a fixing portion. The image forming portion A which forms an image on a sheet P of recording medium has four image forming stations SY, SM, SC and SK which form yellow, magenta, cyan and black images, respectively.

Each image forming station has: a photosensitive drum 1 as a rotatable image bearing member; a charging member 2; and a laser scanner 3, as an exposing means, which exposes the peripheral surface of the photosensitive drum 1 of each image forming station. Further, each image forming station has: a developing device 4 having a toner storage portion 4*a*; a development roller as a developing member; a cleaner 5 which cleans the peripheral surface of the photosensitive drum 1; and a primary transfer roller 6 as the first transferring member. The interface between the peripheral surface of the development roller 4*b*, and the peripheral surface of the photosensitive drum 1 is the development nip N1.

Further, the image forming portion A has: an intermediary transfer belt 7 which is an endless conveying member; a secondary transfer roller 8 as the secondary transferring member; and a cleaner 9 which cleans the outward surface of the belt 7. The belt 7 is in contact with the peripheral surface of the photosensitive drum 1, forming thereby the primary transfer nip N2 between itself and photosensitive drum 1. That is, the interface between the outward surface of the belt 7 and the peripheral surface of the photosensitive drum 1 is the primary transfer nip N2. The secondary transfer roller 8 forms the third transfer nip N3, in coordination with the belt 7.

In the image forming apparatus 100, the photosensitive drum 1 rotates in the direction indicated by an arrow mark at a preset process speed. As the photosensitive drum 1 rotates, its peripheral surface is uniformly charged by the charging member 2 to a preset polarity and potential level (charging process). The scanner 3 scans (exposes) the uniformly charged peripheral surface of the photosensitive drum 1 with a beam of laser light emitted by the scanner 3 (exposing process). Consequently, an electrostatic latent image, which is formed in accordance with information of the image to be formed, is effected on the peripheral surface of the photosensitive drum 1. A development bias (voltage) is applied to the development roller 4*b* from an electric power source V1 (development bias power source, in this embodiment). As a result, toner adheres to latent image on the peripheral surface of the photosensitive drum 1, in the development nip N1, developing thereby the latent image (developing process).

In each image forming station, the primary transfer roller 6 is disposed in a manner opposing the photosensitive drum 1 with the belt 7 located between the photosensitive drum 1 and transfer roller 6. A primary transfer bias (voltage) is applied to the primary transfer roller 6 from an electric power source V2 (primary transfer bias power source, in this embodiment). Thus, the unfixed toner image on the peripheral surface of the photosensitive drum 1 is transferred onto the outward surface of the belt 7 in the primary transfer nip N2 (primary transferring process). The belt 7 continues to rotate, bearing the unfixed toner image.

Sheets P of recording medium stored in a cassette 10 in the main assembly 100A of the image forming apparatus 100 are moved out of the cassette 10 one by one. As each sheet P of recording medium is moved out of the cassette 10, it is delivered to a pair of rollers 13 by the rotation of a pair of rollers 12. Then, the sheet P is conveyed to the secondary transfer nip N3 by the rotation of the pair of rollers 13. To the secondary transfer roller 8, the secondary transfer bias (voltage) is applied from an electric power source V3 (secondary transfer bias power source, in this embodiment). Thus, the unfixed toner image on the outward surface of the belt 7 is transferred onto the sheet P, in the secondary transfer nip N3 (secondary transferring process).

The sheet P of recording medium, which is bearing the unfixed toner image, is sent to the fixing apparatus B, in which it is moved through the fixation nip N4. As the sheet P is moved through the fixation nip N4, the unfixed toner image on the sheet P is fixed to the sheet P (fixing process). After being conveyed out of the fixing apparatus B, the sheet P is discharged into a tray 15 by the rotation of a pair of rollers 14.

Foregoing is the description of the printing operation for forming an image on one of the two surfaces (image formation surfaces) of a sheet P of recording medium.

In a case when an image is formed on the other surface (other image formation surface) of the sheet P, the sheet P is conveyed into a reversal conveyance passage 16 by reversing the rotation of the pair of rollers 14 and conveying sheet P to the pair of rollers 13 for the second time.

Direction Y is a direction perpendicular to the recording medium conveyance direction X. The recording medium conveyance passage 16 of the image forming apparatus 100 can be adjusted in width (in terms of the direction Y) in a range of 70 mm-297 mm. Further, the image forming apparatus 100 is structured so that while a sheet P of recording medium is conveyed through the apparatus 100, the center of the sheet P remains roughly coincidental to the centerline of the recording medium conveyance passage of the apparatus 100, also in terms of the direction Y.

<Fixing Apparatus B>

Figure 2:
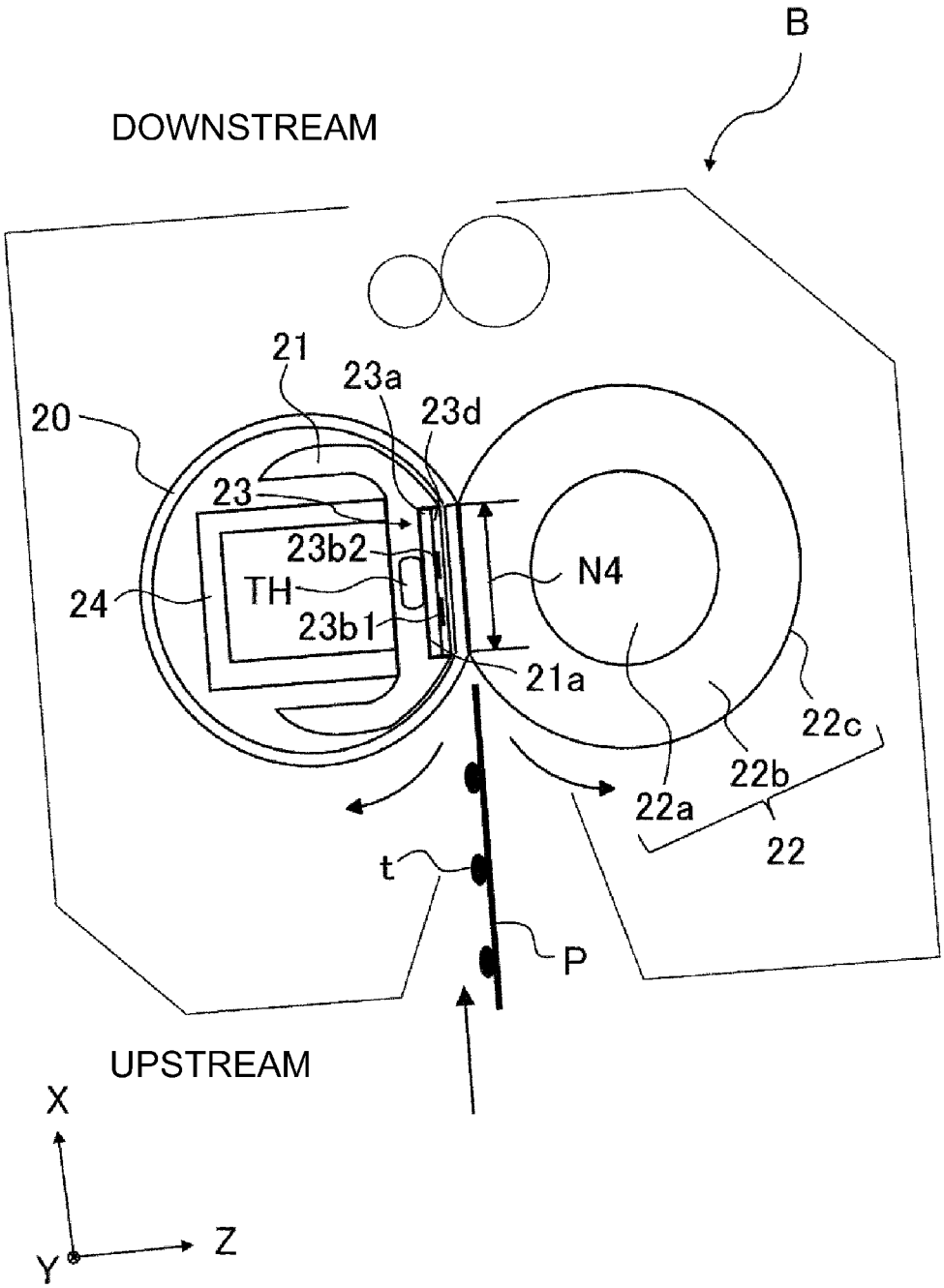
FIG. 2 is a sectional view of the fixing apparatus of the image forming apparatus shown in FIG. 1; it is for showing the general structure of the fixing apparatus.
Figure 3:
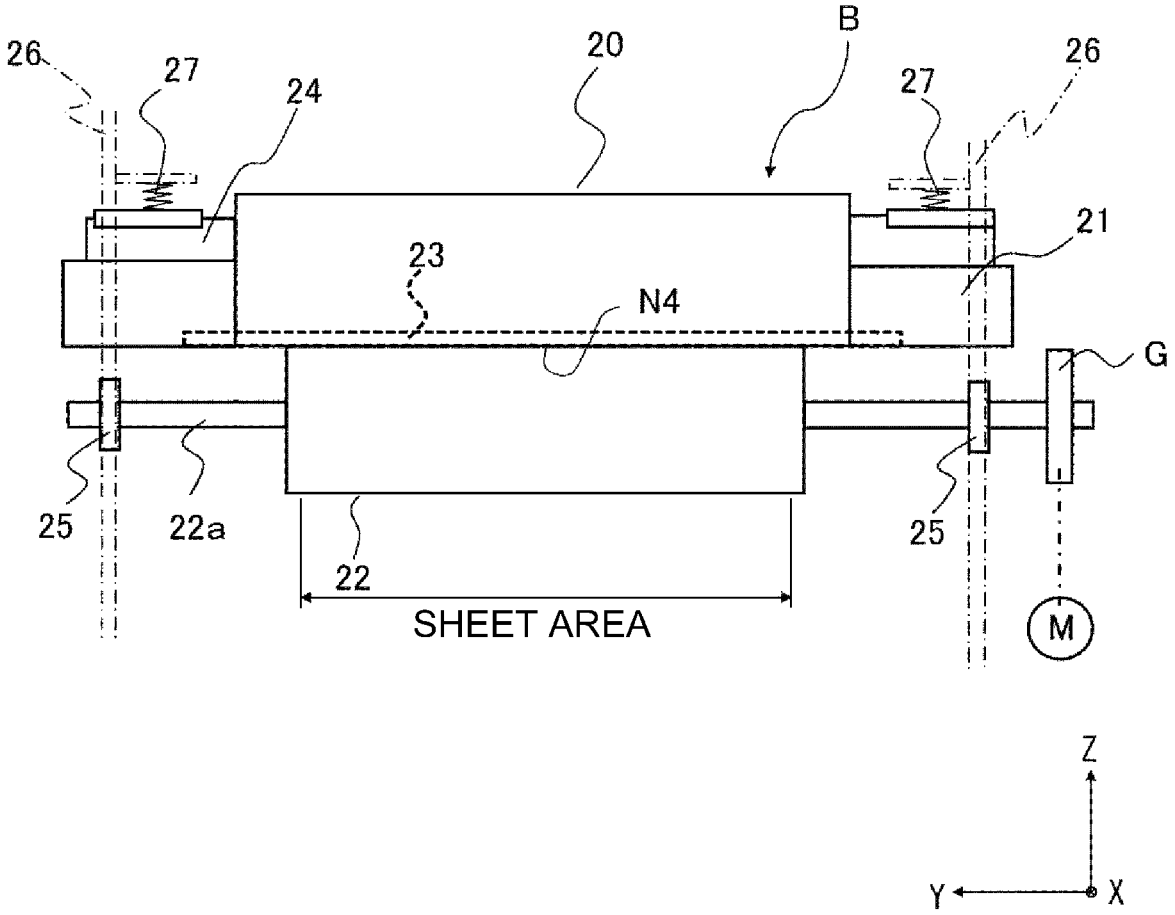
FIG. 3 is a side view of the fixing apparatus as seen from the upstream side of the apparatus in terms of the recording medium conveyance direction X.

Next, referring to FIGS. 2 and 3, the fixing apparatus B is described. The fixing apparatus B shown in FIGS. 2 and 3 is a fixing apparatus of the so-called film heating type. FIG. 2 is a schematic sectional view of the fixing apparatus B, showing the general structure of the fixing apparatus B. FIG. 3 is a side view of the fixing apparatus B as seen from the upstream side of the fixing apparatus B in terms of the recording medium conveyance direction X.

The fixing apparatus B has: a cylindrical film as a rotational heating member; a film guide 21 as a guiding member; a pressure roller 22 as a rotational pressing member; a ceramic heater 23 as a heating member; and a stay 24 as a reinforcing member.

The film 20, which is heat resistant and flexible, is 80 μm in overall thickness in this embodiment. The film 20 is very thin to enable the fixing apparatus B to quickly start up. The film 20 has a substrative layer and a release layer formed on the outward surface of the substrative layer. As the material for the substrative layer, polyimide, polyamide, PEEK, or the like heat resistant resin can be used. In this embodiment, polyimide film which is 65 μm in thickness is used. As the material for the release layer, a heat resistant resin was used to cover the outward surface of the substrative layer. Suitable heat resistant resins include, for example, fluorinated resin (such as PTFE, PFA, FEP), or silicone resin, which are excellent in terms of releasing properties and heat resistant. Such resins may be used alone or in combination to cover the outward surface of the substrative layer.

The guide 21 which is put through the hollow of the film 20 is a member for guiding the film 20 as the film 20 is rotationally moved. The guide 21 functions also as a member for preventing heat from dissipating in the opposite direction from the nip N. It is formed of liquid polymer, phenol resin, PPS, PEEK, or the like heat resistant resin. Further, the guide 21 functions also as a supporting member for supporting the heater 23. The outward surface of the portion of the guide 21, which faces the roller 22, is flat. This flat surface portion of the guide 21 is provided with a groove 21*a* which extends in the direction Y which is perpendicular to the recording medium conveyance direction X. It is in this groove 21*a* that the heater 23 is supported.

Next, referring to FIG. 4, the heater 23 is described. Part (a) of FIG. 4 is a schematic cross-sectional view of the heater 23, showing the general structure of the heater 23. Part (b) of FIG. 4 is a schematic view of the heater 23 as seen from the pressure roller side, also showing the general structure of the heater 23. The single dot chain line in part (b) of FIG. 4 shows the contour of the protective layer 23*d* of the heater 23.

The heater 23 has a ceramic substrate 23*a* (in this embodiment, alumina substrate or aluminum nitride substrate), which is in the form of a long and narrow piece of plate. The flat surface portion of the substrate 23*a*, which is on the pressure roller side, is provided with the first and second heat generating resistors 23*b*1 and 23*b*2, which generate heat as electrical current is flowed through them. The two heat generating resistors 23*b* are disposed in parallel, extending in parallel to the lengthwise direction of the substrate 23*a*. In terms of the recording medium conveyance direction X, the two heat generating resistors 23*b*1 and 23*b*2 are positioned on the upstream and downstream sides, respectively, on the substrate 23*a*. Also in terms of the direction Y which is perpendicular to the recording medium conveyance direction X, the two heat generating resistors 23*b*1 and 23*b*2 are the same in the pattern of heat generation. The material for the heat generating resistors 23*b*1 and 23*b*2 is Ag/Pd (silver/palladium) $RuO_2$, or $Ta_2N$.

The flat surface described above is provided with an electrode 23*c*1 which is in electrical connection to one end of the heat generating resistor 23*b*1, an electrode 23*c*2 which is in electrical connection to one end of the heat generating resistor 23*b*2, a common electrode 23*c*3 which is in electrical connection to the other end of the heat generating resistor 23*b*1 and the other end of the heat generating resistor 23*b*2. Further, the flat surface described above is provided with a low friction layer 23*d* (glass layer, in this embodiment) for not only protecting and electrically insulating the heat generating resistors 23*b*1 and 23*b*2, but also, reducing the friction between the inward surface of the film 20 and the heater 23.

The image forming apparatus 100 in this embodiment is provided with a pair of temperature detection elements TH1 and TH2, which are positioned at the center and one of the end portions of the recording medium conveyance passage, respectively, in terms of the direction Y which is perpendicular to the recording medium conveyance direction X. More concretely, the temperature detection element TH1 is positioned in the portion of the recording medium passage, which both a small sheet of recording medium and a large sheet of recording medium pass, whereas the temperature detection element TH2 is positioned in one of the portions of the recording medium passage, through which the large sheet of recording medium passes, but the small sheet of recording medium does not pass. Both temperature detection elements TH1 and TH2 are supported by the guide 21.

The roller 22 has: a metallic core 22*a* formed of SUS, Al, or the like metallic substance; an elastic layer 22*b* formed on the peripheral surface of the metallic core 22*a*; and a release layer 22*c* formed on the outward surface of the elastic layer 22*b*. The elastic layer 22*b* is formed of silicone rubber, fluorinated rubber, or the like heat resistant rubber, or foamed silicone rubber. The release layer 23*c* is formed of PFA, PTFE, FEP, or the like fluorinated resin. In terms of the direction Y which is perpendicular to the recording medium conveyance direction X, the lengthwise end portions of the metallic core 22*a* are rotatably supported by the frame 26 of the fixing apparatus B, with the placement of a pair of bearings 25, between the frame 26 and the lengthwise end portions of the metallic core 22*a*.

In this embodiment, the roller 22 is 25 mm in external diameter. The elastic layer 25*b* is formed of silicone rubber, and is 3.5 mm in thickness. In terms of the direction Y which is perpendicular to the recording medium conveyance direction X, the length of the roller 2 is 230 mm.

The stay 24 which is put through the hollow of the film 20 is placed on the opposite flat surface of the guide 21 from the roller 2. The stay 24 has a function of reinforcing the guide 21.

Referring to FIG. 3, the end portions of the stay 24 are under the pressure generated by a pair of springs 27 in the direction Z which is parallel to the thickness direction of a sheet of recording medium. Thus, the stay 24 keeps the guide 21 pressed upon the inward surface of the film 20 by the pressure from the springs 27. Therefore, the elastic layer 22*b* of the roller 22 is compressed (elastically deformed), forming a nip (fixation nip N4), which has a preset width in terms of the recording medium conveyance direction X, between the peripheral surface of the roller 22 and the outward surface of the film 20.

<Thermal Fixing Operation>

Next, referring to FIGS. 2, 3 and 5, the thermal fixing operation of the fixing apparatus B is described. FIG. 5 is a diagram of the heater driving circuit 40.

The driving force of the motor M (FIG. 3) is transmitted to the metallic core 22*a* of the roller 22 by way of a gear G, whereby the roller 22 is rotated in the direction indicated by an arrow mark in FIG. 2. Thus, the film 20 is rotated by the rotation of the roller 22 in the direction indicated by an arrow mark in FIG. 2, with the inward surface of the film 20 remaining in contact with the low friction layer 23*d* of the heater 23.

Referring to FIG. 5, the heater driving circuit 40 is an example of circuit which controls the power supply to the heater 23. The signals outputted from the temperature detection element TH1 to indicate the temperature of the heater 23 are inputted into a controlling portion 41 as a controlling means. The controlling portion 41 is made up of a CPU, and memories such as a RAM, a ROM, or the like. It controls the timing with which electric power is supplied to the heater 23 from a pair of power delivery controlling portions 42*a* and 42*b* (which in this embodiment are triacs). The power delivery controlling portion 42*a* is in connection to the heat generating resistor 23*b*1 through an electrode 23*c*1. The power delivery controlling portion 42*b* is in connection to the heat generating resistor 23*b*2 through an electrode 23*c*2. As electric current is supplied to the heat generating resistors 23*b*1 and 23*b*2, the resistors generate heat, causing thereby the heater 23 to quickly increase in temperature.

As for the controlling of the temperature of the heater 23, in order to keep the temperature of the nip at a preset target level, the controlling portion 41 determines the proper duty ratio, wave count, or the like of voltage to be applied to the heat generation resistors, according to the heater temperature detected by the temperature detection elements, and controls the amount by which power is supplied to the heat generating resistors, with the use of the power delivery controlling portion.

In a case where a large sheet of recording medium is introduced into the nip N4, the controlling portion 41 controls the power delivery controlling portions 42*a* and 42*b* in power delivery timing so that the heater temperatures detected and outputted from the temperature detection elements TH1 and TH2 remain at the preset level (fixation temperature which hereafter may be referred to as "target temperature"). With this control, the temperature of the nip N4 is kept at the preset target level. As a large sheet of recording medium, on which an unfixed toner image is present, is conveyed through the nip N4 while remaining pinched between the roller 22 and film 20, the sheet and the toner image thereon are heated and pressed, whereby the toner image is fixed to the surface of the sheet P.

In a case where a small sheet of recording medium is introduced into the nip N4, the controlling portion 41 controls the power delivery controlling portions 42*a* and 42*b* in power delivery timing so that the heater temperatures detected by, and outputted from, the temperature detection elements TH1 remains at the preset level (fixation temperature which hereafter may be referred to as "target temperature"). With this control, the temperature of the nip N4 is kept at the preset target level. As a small sheet of recording medium, on which an unfixed toner image is present, is conveyed through the nip N4 while remaining pinched between the roller 22 and film 20, the sheet and the toner image thereon are heated and pressed, whereby the toner image is fixed to the surface of the sheet P.

<Method for Forming Impression of Fixation Nip N4, and Method for Reading Nip Impression>

In the following description of the preferred embodiments of the present invention, in order to differentiate a sheet P of recording medium on which an image t is formed through the normal printing operation from a sheet P of recording medium on which a nip impression to for obtaining (indirectly measuring) the nip width is formed, the latter will be referred to as sheet S, hereafter.

One of the notable characteristics of the image forming apparatus in this embodiment is that it forms an impression of the nip across a fixed toner image formed on a sheet S to obtain (indirectly measure) the nip width, and changes the heater of its fixing apparatus in temperature setting, according to the results of the reading of the nip impression by its image reading apparatus.

Next, this procedure is concretely described.

The image formation controlling portion (unshown) is made up of a CPU, and memories such as a RAM and a ROM. In the memory, a nip width obtaining sequence, which is to be carried out to obtain the width of the nip N4, in terms of the recording medium conveyance direction X, is stored in addition to an image formation sequence, which is to be carried out for the ordinary printing operation described above. Hereafter, the nip width obtaining sequence will be referred to as "nip width measuring sequence", for convenience sake. The heater driving circuit 40 is controlled by the image formation controlling portion when the image formation sequence is carried out, and also, when the nip width measuring sequence is carried out.

It is in a case where the image formation controlling portion is demanded by an operator through the control panel, with which the main assembly 100A is provided, or by a host computer that the image formation controlling portion carries out the nip width measuring sequence. As the image formation controlling portion begins to carry out the nip width measuring sequence, first, it opens the nip width measurement image ta stored in its memory. Then, it forms the nip width measurement image ta for measuring the nip width, on the sheet S, through the same image forming operation as the ordinary one, yielding thereby a nip width measurement sheet S.

That is, in the image forming portion A, in order to form a toner image having one or more preset colors, on the sheet S, each of the following processes are synchronously carried out. That is, the charging process to be carried out by the charge roller 2, exposing process to be carried out by the scanner 3, developing process to be carried out by the development roller 4*b*, primary transferring process to be carried out by the primary transfer roller 6, and secondary transferring process to be carried out by the secondary transfer roller 8 are carried out in synchronism with the movement of the sheet S. Thus, two or more monochromatic toner images different in color are sequentially formed in layers on the sheet S. That is, an unfixed toner image ta for measuring the nip width is formed on the sheet S, of two or more toners which are different in color.

FIG. 6 shows the shape and size of the unfixed toner image ta borne on the sheet S.

The nip width measurement image ta may be solid image or a halftone image. A halftone image is made up of numerous dots. Therefore, in case where a halftone image was used as the nip width measurement image ta, the image reading apparatus sometimes failed to accurately recognize the borderline between the nip imprint N4*m* and its background. In this embodiment, therefore, a solid image which enables the image reading apparatus to clearly (accurately) read the borderline was used as the nip width measurement image ta. By the way, the greater the nip width measurement image ta is in the amount of the toner, the clearer is the contrast between the nip imprint N4*m* and its background, that is, the easier it is for the image reading apparatus to recognize the borderline. On the other hand, if the nip width measurement image ta is excessively large in the amount of toner, it is possible for the sheet S to wrap around the film 20.

In this embodiment, therefore, in consideration of the issues described above, a sold image was formed as the nip width measurement image ta, of two toners which are different in color, for example, magenta and cyan toners.

The nip width measurement image ta is fixed to the sheet S through the process in which the sheet S having the nip width measurement image ta is conveyed through the nip N4 of the fixing apparatus B, while being heated and remaining pinched between the film 20 and roller 22.

After being conveyed out of the fixing apparatus B, the sheet S is conveyed further by the rotation of the pair of rollers 14. While the sheet S is conveyed by the pair of rollers 14, the rollers 14 is stopped and begin to be rotated in reverse. Consequently, the sheet S is conveyed into a reversal conveyance passage 16, and is conveyed through the reversal conveyance passage 16 by the rotation of rollers 17 and 18 to be conveyed to the pair of rollers 13 for the second time, being thereby turned over. Then, the sheet S is delivered to the nip N4 for the second time by the rotation of the rollers 13.

Then, the sheet S is conveyed through the fixing apparatus B for the second time, remaining pinched between the film 20 and roller 22. While the sheet S is conveyed through the nip N4, the roller 22 and film 20 are stopped for a preset length of time. In this embodiment, the rollers 22 and film 20 are stopped roughly 10 seconds. However, it is not mandatory that the roller 22 and film 20 are stopped roughly 10 seconds. That is, the length of time the roller 22 and film 20 are to be stopped is to be set according to the structure of the fixing apparatus B, and the characteristic of the toner used for the formation of the image ta, for example, how easily the toner melts. While the roller 22 and film 20 are kept stationary, the part of the fixed nip width measurement image ta, which is in the nip N4, is melted for the second time by the heat stored in the roller 22. Consequently, a nip impression N4*m* is formed across the nip width measurement image ta. FIG. 7 shows the nip impression N4*m* formed across the nip width measurement image ta. The nip impression N4*m* is greater in gloss than the other parts of the nip width measurement image ta. Therefore, it is clearly detectable as the nip impression N4*m*, as it is in FIG. 7.

As the sheet S comes out of the fixing apparatus B, it is conveyed again by the rotation of the roller 14. While the sheet S is conveyed, the roller 14 is stopped, and rotated in reverse. Thus, the sheet S is conveyed into a reversal conveyance passage 16. Then, the sheet S is conveyed to the image reading apparatus 30 which is between rollers 17 and 18, and in which the nip width measurement image ta is read. Then, the sheet S is conveyed through the fixing apparatus B, and is discharged into the tray 15. By the way, the image forming apparatus 100 may be structured so that the rollers 14, 17, and 18 are rotated in reverse to discharge the sheet P into the tray 15 after the nip impression N4*m* is read by the image reading apparatus 30.

<Image Reading Apparatus 30 (Image Reading Means)>

At this time, referring to FIGS. 8 and 9, the image reading apparatus 30 as an image reading means is described. FIG. 8 is a schematic drawing of a combination of LED 31, CMOS line sensor 32, and focal lens 33 of the image reading apparatus 30, as seen from the nip width measurement image ta side of the sheet S. FIG. 9 is a block diagram of a combination of the image reading apparatus 30, heater driving circuit 40, and heater 23. It shows the relationship among them.

The image reading apparatus 30 reads the nip width measurement image ta, while the sheet S is conveyed by the rollers 17 and 18. Referring to FIGS. 8 and 9, the image reading apparatus 30 has the LED 31, CMO line sensor 32, and focal lens 33, which are arranged in the direction Y which is perpendicular to the recording medium conveyance direction X so that a part of the nip width measurement image ta on the sheet S can be read.

The driving-computing controlling portion 34 drives the LED 31 and line sensor 32. The image reading apparatus 30 is structured so that as the LED 31 and line sensor 32 are driven, the beam of light emitted from the LED 31 is projected upon the surface of the sheet S, which has the nip width measurement image ta.

As the beam from the LED 31 is reflected (deflected) by the surface of the sheet S having the nip width measurement image ta, it is focused by the focal lens 33 so that the image of the nip width measurement image ta is formed on the surface of the line sensor 32, which has numerous light sensing elements. The light sensing elements output electrical signals (voltage), which change in magnitude in response to the amount of light to which they are subjected. That is, the line sensor 32 outputs the electrical signals, which change in voltage in response to the amount of light reflected (deflected) by the sheet S (the nip having width measurement image ta thereon), to the driving-computing controlling portion 34.

As the driving-computing controlling portion 34 receives the signals from the line sensor 32, it converts them into digital signals (A-D conversion: 256 levels of tone), and outputs the digital signals to the controlling portion 41 of the heater driving circuit 40.

As the controlling portion 41 receives the digital signals which correspond to the analog signals which are sequentially outputted from the light sensing elements of the line sensor 32, it generates area information of the image formation surface and the nip width measurement image ta, in terms of the direction Y which is perpendicular to the recording medium conveyance direction X, by sequentially connecting the digital signals, while the sheet S is conveyed. The line sensor 32 used in this embodiment is 20 mm in the effective length of its light sensing element, in terms of the direction Y which is perpendicular to the recording medium conveyance direction X, and 600 dpi in resolution. While the sheet S is conveyed through the image reading apparatus 30, the controlling portion 41 obtains the image of the image formation surface and the image of the nip width measurement image ta which are 600 dpi×600 dpi in resolution, by generating the sequential area information described above.

The nip impression N4*m* read as an image by the image reading apparatus 30 is measured by the controlling portion 41, based on the digital signals which correspond to the light sensing elements of the line sensor 32, and which correspond to the center portion of the roller 22 in terms of the direction Y which is perpendicular to the recording medium conveyance direction X. FIG. 10 shows the relationship between the digital signal strength and the position in the nip width measurement image ta, in terms of the recording medium conveyance direction X, in particular, the relationship between the digital signals and the light sensing elements of the line sensor 32, which correspond in position to the center portion of the roller 22. As is evident from FIG. 10, the controlling portion 41 uses a threshold value Vt as the reference, and determines the width of the area in which the signals (voltages) outputted by the line sensor 32 is lower than the threshold value Vt, as the width of the nip N4 in terms of the recording medium conveyance direction X.

By the way, the softer the elastic layer 22*b* of the roller 22 is, the longer the length of time it takes for the sheet P of recording medium to pass the nip N4, and therefore, the greater the amount by which heat transfers to the sheet P and the toner thereon. That is, the softer the elastic layer 22*b* of the roller 22 is, the more effectively the roller 22 melts toner.

While the fixing apparatus B is in use, the roller 22 is repeatedly subjected to the heat from the heater 23, and the physical stress from the pressure applied the springs. Thus, the elastic layer 22*b* of the roller 22 is likely to deteriorate (soften) with the elapse of time. More specifically, as the roller 22 is subjected to high temperature in the nip N4 while a sheet P of recording medium is conveyed through the nip N4, the rubber molecules of the elastic layer 22*b* are severed. Consequently the elastic layer 22*b* deteriorates (softens). The higher the temperature of the heat to which the roller 22 is subjected is, the faster the roller 22 is likely to deteriorate (soften). Thus, the manner in which the roller 22 changes in hardness is affected by the actual condition under which it is used.

For example, generally speaking, when a sheet of ordinary paper is conveyed through the nip N4, the target temperature of the heater 23 is set higher than when a sheet of thin paper is conveyed. Therefore, when a certain number of sheets P of ordinary paper is conveyed through the nip N4, the roller 22 is more likely to soften than when the same number of sheet P of thin paper is conveyed. In other words, even if two image forming operations are the same in the number of sheets of recording medium to be conveyed through the image forming apparatus 100 (fixing apparatus B), how the roller 22 is changed in hardness is affected not only by the sheet count but also the actual conditions under which the apparatus 100 is operated.

The roller 22 used in this embodiment was 55° in hardness when it was tested in hardness, with a hardness gauge of Asker C type placed in contact with its peripheral surface, with the application of 9.8 N (1 kgf) of weight.

Shown in Table 1 is the relationship among the hardness of the roller 22 used in this embodiment, width of the nip N4, and amount by which target temperature is to be adjusted to keep the fixing apparatus B at a preset level in performance. Generally speaking, as the roller 22 reduces in hardness by 2 degrees, the nip width increases by 0.5 mm. Therefore, in order to keep the performance of the fixing apparatus B at a preset level, the target temperature needs to be reduced by 3 degrees.

TABLE 1

| Fixing roller hardness (degs.) | Nip width (mm) | Correction of target temperature (degs.) |
|---|---|---|
| 55 | 9.5 | Ref. |
| 54 | 9.8 | −2 |
| 53 | 10.0 | −3 |
| 52 | 10.1 | −4 |

Therefore, the controlling portion 41 changes the heater 23 in target temperature based on the relationship among the width of the nip impression N4*m* read by the image reading apparatus 30, hardness of the pressure roller 22, and target temperature adjustment amount, shown in Table 1. That is, the controlling portion 41 changes the target temperature (temperature setting) according to the result of reading of the nip impression N4*m* by the image reading apparatus 30. By the way, the relationship between the nip width and target temperature adjustment amount is stored in the form of a table in the memory of the controlling portion 41.

FIG. 11 is a graph which shows the predictable relationship among the hardness of the roller 22, cumulative number of sheets of recording medium conveyed through the fixing apparatus B, condition under which the image forming apparatus 100 is used by a user A, and conditions under which the image forming apparatus 100 was used by a user B.

The user A is greater in the frequency with which images are formed on sheets of cardstock. That is, the user A is greater in the frequency with which images are formed with the target temperature set at a higher level. In other words, the user A uses the image forming apparatus 100 under such a condition that the roller 22 is likely to deteriorate (soften) faster. On the other hand, the user B is higher in the frequency with which images are formed on sheets of thin paper, that is, the frequency with which images are formed with the target temperature set lower. In other words, the user B forms images under such a condition that the roller 22 is less likely to change in hardness.

Referring to FIG. 11, when the cumulative number by which sheets are conveyed is K, the predictable hardness of the roller 22 is 53°. In comparison, when the image forming apparatus 100 were used by the users A and B, the hardness of the roller 22 was 52° and 54°, respectively, when the cumulative sheet conveyance count was K. Therefore, if the fixing apparatus B is adjusted in fixation temperature based on the predictable hardness of the roller 22 as in the past, the target temperature is under-adjusted for the user A, and is over-adjusted for the user B. Therefore, in a case where the image forming apparatus 100 is used by the user A, the so-called hot offset is likely to occur, whereas in a case where the apparatus 100 is used by the user B, images are likely to be insufficiently fixed.

In comparison, in this embodiment, the nip width measurement sequence is regularly (every 10000th sheet, for example) carried out to actually obtain the width of the nip N4. Then, the target temperature adjustment amount is determined based on the actually obtained width of the nip N4. Therefore, even if the hardness of the roller 22 is made different from the predicted one, by the actual condition under which the image forming apparatus 100 was used, and which was different from the normal (predictable) condition, it is possible to prevent the occurrence of such issues as the hot-off and under-fixation. That is, it is possible to prevent the occurrence of the image defects attributable to the change in the width of the nip N4.

Further, because of the tolerance in the manufacturing of the fixing apparatus B, all the fixing apparatuses are not the same in the initial width of the nip N4. Therefore, all fixing apparatuses are not the same in initial performance. Therefore, the nip width measurement sequence may be carried out in the early stage of the usage of the fixing, apparatus B, in order to compensate for the nonuniformity of the fixing apparatus B in performance.

In this embodiment, the image reading apparatus 30 was placed between the rollers 17 and 18. However, this embodiment is not intended to limit the present invention in the positioning of the image reading apparatus 30. For example, the image reading apparatus 30 may be placed in the reversal conveyance passage 16. That is, the image reading apparatus 30 may be placed in any place as long as the place enables the image reading apparatus 30 to reliably read the nip impression N4*m*. Further, the image reading apparatus 30 may be placed in any portions of the recording medium conveyance passage, between the upstream side of the roller 13, and the downstream side of the roller 14 which is on the downstream side of the secondary transfer nip N3 and fixation nip N4, in terms of the recording medium conveyance direction X.

Further, in this embodiment, the nip impression N4*m* is formed in the nip width measurement image ta, by temporarily stopping the rotation of the roller 22 of the fixing apparatus B and film 20 with such timing that the nip width measurement image ta on the sheet S faces the roller 22. However, this embodiment is not intended to limit the present invention in scope in terms of how the nip impression N4*m* is to be formed. For example, the nip impression N4*m* may be formed across the nip width measurement image ta, by stopping the sheet S in the nip N4 by stopping the rotation of the roller 22 and film 20 of the fixing apparatus B with such timing that the nip width measurement image ta on the sheet S faces the film 20.

The heating method to be employed by the fixing apparatus B does not need to be limited to a heating method which employs a heating film as in this embodiment. It may be a heating method based on electromagnetic induction, a heating method which employs a heat roller, or a method which employs a heating belt. A fixing apparatus based on electromagnetic induction is such a fixing apparatus that the magnetic flux from its excitation coil is caught by its electrically conductive film to induce eddy current in the film to heat the film by the heat generated in the film by electromagnetic induction. A fixing apparatus which employs a heat roller is such a fixing apparatus that the radiant heat from its halogen heater is used to heat its heating roller. A fixing apparatus which employs a heating belt is such a fixing apparatus that the nip is formed by pressing its belt against its roller by its pressing member positioned on the inward side of the inward surface of the loop (belt loop) which the belt forms.

It is not mandatory that, in order for the present invention to be applicable to an image forming apparatus, the apparatus has a reversal conveyance passage like the reversal conveyance passage 16 of the image forming apparatus in this embodiment. In a case where an image forming apparatus does not have a reversal conveyance passage 16, the image reading apparatus 30 can be placed on the upstream side of the roller 14 in terms of the recording medium conveyance direction X (position indicated by broken line in FIG. 1). In such a case, the nip width measurement image to on the sheet S is to be read through the following procedure.

The nip width measurement image ta is printed on the sheet S with the use of the image forming apparatus 100, and the sheet S is discharged into the tray 15. Then, the sheet S is set in a cassette 10 in such an attitude that the image formation surface of the sheet S, which has the nip width measurement image ta, faces the roller 22. Then, while the sheet S is conveyed through the nip N4 of the fixing apparatus B, the rotation of the roller 22 and film 20 is stopped to form the nip impression 4Nm across the nip width measurement image ta on the sheet S. Then, the conveyance of the sheet S is restarted to read the nip width measurement image ta with the use of the image reading apparatus 30. Then, the sheet S is discharged into the tray 15.

Embodiment 2

Next, another example of image forming apparatus 100 is described. The image forming apparatus in this embodiment changes the temperature setting (duty ratio of power supply to first and second heat generating resistors), according to the results of reading of an image of the fixation nip N, by the image reading apparatus 30. In the following description of this embodiment only the differences in structure from the image forming apparatus 100 in this first embodiment are described.

Next, referring to FIG. 12, the heater 23 is described. Part (a) of FIG. 12 is a schematic cross-sectional view of the heater 23. It shows the general structure of the heater 23. Part (b) of FIG. 12 is a top view of the heater 23 as seen from the direction of the roller 22. It also shows the general structure of the heater 23. The single dot chain line in part (b) of FIG. 12 shows the contour of the protective layer 23*d* of the heater 23.

The heater 23 in this embodiment has a substrate 23*a*, the first heat generating resistor 23*e*1 and the second heat generating resistors 23*e*2. The two resistors 23*e*1 and 23*e*2 are positioned on the opposite flat surface of the substrate 23*a* from the roller 22 so that they extend in the direction Y which is perpendicular to the recording medium conveyance direction X.

The two heat generating resistors 23*e*1 and 23*e*2 are different in the pattern of heat generation per unit area in terms of the direction Y which is perpendicular to the recording medium conveyance direction X. More specifically, the heat generating resistor 23*e*1 or the upstream one in terms of the direction Y which is perpendicular to the recording medium conveyance direction X is formed so that it is highest in the amount of heat generation at its center in terms of the direction Y which is perpendicular to the recording medium conveyance direction X, and gradually reduces in the amount of heat generation toward its lengthwise ends. On the other hand, the heat generating resistor 23*e*2 is formed so that it is smallest in the amount of heat generation at its center, and gradually increases in the amount of heat generation toward its lengthwise ends in terms of the direction Y which is perpendicular to the recording medium conveyance direction X.

Referring to the same drawing, a referential code 23*f* stands for a protective layer (which in this embodiment is a coated glass layer) provided on the abovementioned flat surface of the substrate 23*a* to protect and electrically insulate the heat generating resistors 23*e*1 and 23*e*2. A referential code 23*g* stands for a low friction layer (which in this embodiment is polyimide layer) provided on the flat surface of the substrate 23*a*, which is on the roller 22 side, to minimize the friction between the heater 23 (substrate 23*a*) and film 20.

Shown in FIG. 13 are the pattern of heat generation of the first heat generating resistor 23*e*1, that of the second heat generating resistor 23*e*2, in terms of the direction Y which is perpendicular to the recording medium conveyance direction X, and the pattern of the total amount of heat generation of the combination of the first and second heat generating resistors 23*e*1 and 23*e*2. Each of the heat generating resistors 23*e*1 and 23*e*2 of the heater 23 in this embodiment is designed so that if the electrical power with the first heat generating resistor 23*e*1 is supplied is the same in voltage and duty ratio as that, with which the second heat generating resistor 23*e*2, the graph which shows the pattern of the total amount of heat generation of the heater 23 becomes flat.

Next, referring to FIGS. 14 and 15, a heater driving circuit 60, and the relationship between the ratio of the duty of the power supply to the second heat generating resistor 23*e*2, relative to the duty of the power supply to the first heat generating resistors 23*e*1, and pattern of heat generation of the heater 23 is described. FIG. 14 is a combination of a heater driving circuit 60, and the circuit of the heater 23, which is a part of the heater driving circuit 60.

Referring to FIG. 14, the heater driving circuit 60 is an example of driving circuit that controls the heater 23. The detected temperature of the heater 23, which is outputted from a temperature detection element TH1, is inputted into the control portion 61 as a controlling means. The control portion 61 is made up of a CPU or memories such as an RAM and ROM. The control portion 61 controls the power delivery controlling portions 42*a* and 42*b* (which in this embodiment are triacs) in their power delivery timing, based on the temperature detected by the temperature detection element TH1. The power delivery controlling portion 42*a* is connected to the heat generating resistor 23*e*1 through an electrode 23*c*1. The power delivery controlling portion 42*b* is connected to the heat generating resistor 23*e*2 through an electrode 23*c*2.

Therefore, the controlling portion 61 can set a proper duty Da for the power to be delivered by the power supply controlling portion 42*a*, and a proper duty Db for the power to be supplied by the power delivery controlling portion 42*b*, to provide with each heat generating resistor with a preset heat generation pattern in terms of the direction Y which is perpendicular to the recording medium conveyance direction X.

The details of the method for determining a proper value for the duty Da for the power to be delivered by the power supply controlling portion 42*a*, and a proper value for the duty Db for the power to be delivered by the power supply controlling portion 42*b* is described later.

The heater 23 is attached to the heater driving circuit 60, and the proper ratio of the duty of the power supplied by the power supply controlling portion 42*b* relative to the duty of the power supplied by the power supply controlling portion 42*a* is determined by the controlling portion 61 to control each power supply controlling portion. Therefore, it is possible to provide the heater 23 with any pattern of heat generation in terms of the direction Y which is perpendicular to the recording medium conveyance direction X.

Shown in FIG. 15 is an example of a pattern of heat generation of the heater 23, which reflects the aforementioned power supply duty ratio. In this embodiment, if the power supply duty ratio Db/Da=1/1, for example, the pattern of heat generation is flat. If the power supply duty ratio Db/Da<1, for example, Db/Da=0.7/1, the pattern of heat generation is highest at the center (shaped like mountain). If the power supply duty ration Db/Da>1, for example, Db/Da=1/0.7, the pattern of heat generation is lowest at the center (being shaped like valley).

In this embodiment, Db/Da, or the ratio of the duty of the power supply delivered to the heat generation resistor 23*e*2 relative to the duty of the power supply delivered to the heat generating resistor 23*e*1 is changed as shown in Table 2 by the controlling portion 61 according to the size of a sheet P of recording medium. That is, in a case where a largest (widest) sheet P of recording medium, for example, in a case where a sheet P or recording medium of size A4 is introduced into the nip N in the landscape mode, the power supply duty ratio Db/Da is set to 1/1 (Db/Da=1/1) to make the heater 23 uniform in the amount of heat generation per unit area in terms of the direction Y which is perpendicular to the recording medium conveyance direction X. With this arrangement, it is possible to make the area of the fixation nip, through which a sheet P of recording medium of the size A4, uniform in fixation.

On the other hand, in a case where a sheet P of recording medium, which is smaller than the largest (widest) sheet P of recording medium, for example, a sheet P of recording medium of a letter size, is introduced into the nip in landscape mode, the power supply duty ration Db/Da is set to 0.5 (Db/Da 0.5/1) to reduce the heat generation resistor 23*e*2 in the amount of heat generation. With this arrangement, it is possible to reduce in the amount of heat generation, the out-of-sheet-path portion, that is, the portion of the heater 23 which the sheet P does not pass, and therefore, it is possible to minimize the out-of-sheet path portion in temperature increase.

TABLE 2

| Enegization duty ratio Db/Da | Sheet size |
|---|---|
| 1/1 | 290-297 mm (e.g. A3 in portrait, A4 in landscape) |
| 0.5/1 | 268-289 mm (e.g. Leisure in portrait, Letter in landscape) |

Shown in FIG. 16 is the flowchart of the heater driving sequence carried out by the controlling portion 61 of the heater driving circuit 60. The flowchart shown in FIG. 16 corresponds to a case where images are continuously formed on sheets P of recording medium of a letter size when the sheets are conveyed in the landscape mode.

As the printing command for a given printing job is inputted into the image forming apparatus 100, the delivery of electric power to the heater for making the heater 23 generate heat is started, in synchronism with the starting of driving of the motor of the fixing apparatus B (S11). In the case of this printing operation, it is assumed that, during the warm-up period, the target temperature for the heater 23 is set to 215° C., and the power delivery duty ratio Db/Da for the temperature controlling portions 42*a* and 42*b* is set to 1 (Db/Da=1). That is, Da is 100%, and Db also is 100%.

Here, "warm-up period" means the period between when the power begins to be supplied to the heat generating resistor 23*e*1 and/or heat generation resistor 23*e*2 and when a sheet P of recording medium having an unfixed toner image begins to be conveyed to the nip N4.

Setting the power supply duties Da and Db to 100% enables the heat generating resistors 23*e*1 and 23*e*2 to output the maximum amount of heat, making it possible for the heater 23 to increase in temperature as fast as possible. As the temperature detected by the temperature detection element TH1 reaches 200° C. (S12), PI control is started (S13).

Next, in S14, a sheet P of recording medium is delivered to the nip N4. The sheet delivery timing may be earlier than the PI control start timing (S13), as long as the unfixed toner image on the sheet P is satisfactorily fixed.

As soon as the trailing edge of the preceding sheet P of recording medium is discharged from the nip N4 (S15), it is checked whether the power supply duty ratio Db/Da has been switched to 0.5/1 (S16). In a case where it was found in S16 that the power supply duty ratio has not been changed, the temperature detected by the temperature detection element TH1 and that detected by the temperature detection element TH2 are compared with each other (S17). In a case where it is determined in S17 that the temperature detected by the temperature detection element TH2 is higher than that by the temperature detection element TH1, the power supply duty ratio Db/Da is switched to 0.5/1 before the delivery of the next sheet P of recording medium to the nip N4 (S18).

Switching the power supply duty ratio Db/Da to 0.5/1 as described above makes it possible to minimize the amount by which the out-of-sheet-path portions of the nip N4, or the portions of the nip N, through which a sheet P of recording medium does not pass, excessively increases in temperature. By the way, in a case where it is determined in S16 that the power supply duty ration Db/Da has been switched to 0.5/1, steps S16 and S17 are not taken.

In S19, it is determined whether or not the printing operation has been completed. If it is determined that the printing operation has not been completed, steps S14-S17 are repeated. If it is determined that the printing operation has been completed, the operation is ended.

Here, "PI control" means such control that is for determining a hypothetical proper value for the duty D for the power supply to the heater 23 by a combination of proportional control and integral control. Duty D is expressible in the form of Formula 1.

$$D = \text{Proportional control component} + \text{Integral control component} \quad (1)$$

Here, the proportional control component is a value obtainable by multiplying coefficient Kp of proportionality by ΔT (=detected temperature−target temperature). It is obtained every 20 ms. As for the integration control component, it is determined based on a value ΣΔT obtained by integrating ΔT every 20 ms. That is, the integration control component is increased or reduced so that it is increased by 1.0% (+1.0%) with such timing that ΣΔT becomes greater than 36 (ΣΔT>36), and decreased by 1.0% (−1.0%) with such timing that ΣΔT become smaller than −60 (ΣΔT<−60).

Based on the hypothetical power delivery duty D obtained as described above, the controlling portion 61 determines the power delivery duty Da for the temperature controlling portion 42*a* and the power delivery duty Db for the temperature controlling portion 42*b* using Formulas 2 and 3.

$$Da = D \times \alpha \quad (2)$$

$$Db = D \times \beta \quad (3)$$

Here, α and β stand for value of the power supply duty ratio Db/Da=α/β and are set for each of recording medium sizes. The value of α and β is not less than 0 and is no more than 1. If α>β, α=1, whereas if α<β, α=β=1.

<Image Reading Apparatus 50 (Image Reading Means)>

At this time, referring to FIGS. 17 and 18, the image reading apparatus 50 as a image reading means is described. FIG. 17 is a schematic view of a combination of the LED 51, light guiding member 52, CMOS line sensor 54, and focal lens 53 of the image forming apparatus 50 as seen from the direction of the nip width measurement image ta. FIG. 18 is a block diagram which shows the relationship among the image reading apparatus 50, heater driving circuit 60, and heater 23.

While the sheet S is conveyed by rollers 17 and 18, the image reading apparatus 50 reads the nip width measurement image ta. Referring to FIGS. 17 and 18, the image reading apparatus 50 has a light guiding member 52, a focal lens 53, and a line sensor 54, which is long enough to read the entirety of the sheet S in terms of the direction Y which is perpendicular to the recording medium conveyance direction X. The light guiding member 52 is a member for guiding the light emitted from the LED 51, to the image formation surface of the sheet S.

In the image reading apparatus 50, a driving-computing controlling portion 55 drives an LED 51 and a line sensor 54. Thus, the beam of light projected from the LED 51 is guided onto the image formation surface of the sheet S on which the nip width measurement image ta is borne, through the light guiding member 52. The portion of the beam of light reflected by the image formation surface and nip width measurement image ta is focused, through the focal lens 53, on each of the light sensing elements of which the line sensor 54 is formed. The line sensor 54 outputs to the driving-computing controlling portion 55, electrical signals which change in voltage in proportion to the amount by which the beam of light was reflected (deflected), for each of the pixels formed by the reflected portion of the beam of light.

As the driving-computing controlling portion 55 receives the signals from the line sensor 54, it converts the signals (analog signals) into digital signals, which represent 256 levels of tones. Then, it outputs the digital signals to the controlling portion 61 as a means for controlling the heater driving circuit 60.

As the sheet S is conveyed, the controlling portion 61 continuously receives the digital signals which are sequentially outputted from the light sensing elements of the line sensor 45, and generates area information of the image formation surface and nip width measurement image ta, in terms of the direction Y which is perpendicular to the recording medium conveyance direction X, by connecting them as they arrive. The line sensor 54 used by the image forming apparatus in this embodiment is 297 mm in effective length of its light sensing element in terms of the direction Y which is perpendicular to the recording medium conveyance direction X, and 600 dpi in resolution. While the sheet S is conveyed through the image reading apparatus 50, the controlling portion 61 obtains the information of the image formation surface and nip width measurement image ta, which is 600 dpi×600 dpi in resolution, by generating the sequential area information described above.

One of the distinctive characteristics of this embodiment is that not only is the result of reading of the nip impression N4*m* in the nip width measurement image ta used to adjust the heater 23 in target temperature, as in the first embodiment, but also, is used to adjust in the ratio of the duty of the power supply to the heat generating resistor 23*e*2 relative to that to the heat generation resistor 23*e*1. That is, the controlling portion 61 adjusts the power supply duty ratio Db/Da based on the results of the reading of the nip impression N4*m*.

By the way, the fixing apparatus B is designed so that its fixation nip remains uniform in width in terms of the direction Y which is perpendicular to the recording medium conveyance direction X. However, there is no guarantee that the elastic layer of the roller 22 remains uniform in hardness in terms of the direction Y which is perpendicular to the recording medium conveyance direction X.

In a case where a substantial number of small (narrow) sheets P of recording medium are continuously conveyed through the fixation nip N4, the heat from the portion of the heater 23 which in the sheet path portion of the nip, is conveyed out of the fixing apparatus B by being given to the sheet P. However, in the out-of-sheet-path area of the fixation nip N, the heat from the heater 23 accumulates in such members as the film 20 and roller 22. Therefore, in the out-of-sheet-path areas, temperature increase is likely to be greater. Thus, the effects of the heat from the heater 23 upon the roller 22 are nonuniform in terms of the direction Y which is perpendicular to the recording medium conveyance direction X.

Further, the higher the temperature to which the elastic layer 22*b* of the roller 22 is subjected, the greater the change in hardness of the elastic layer. Therefore, the change in hardness of the elastic layer 22*b* of the roller 22 is greater in the out-of-sheet-path areas than in the sheet-path area. Thus, the end portions of the fixation nip N4 in terms of the direction Y which is perpendicular to the recording medium conveyance direction X becomes greater in width than the center portion.

On the other hand, in a case where a substantial number of small (narrow) sheets P of recording medium are intermittently conveyed through the fixation nip N4, the temperature of the end portions of the roller 22 in terms of the direction Y which is perpendicular to the recording medium conveyance direction X sometimes becomes lower than that of the center portion of the roller 22. Here, "intermittently conveyed" means that the interval between two consecutively conveyed sheets P of recording medium is relatively long.

The reason why the temperature of the end portions of the roller 22 in terms of the direction Y which is perpendicular to the recording medium conveyance direction X become lower than that of the center portion of the roller 22 is thought to be as follows. That is, each of the end portions has a vertical surface area, or an additional surface area. Therefore, it is greater in the amount of surface area which is exposed to the ambient air, being therefore greater in the amount of heat radiation. Further, in a case where sheets of recording medium are intermittently conveyed, the interval between two consecutively conveyed sheets P of recording medium is relatively long, and therefore, the length of time heat radiates from the roller 22 during sheet intervals is longer than in a case where sheets p of recording medium are "continuously" conveyed.

Therefore, in a case where sheets P of recording medium are intermittently conveyed, the change in hardness of the elastic layer 22*b* of the roller 22 is likely to be greater across the center portion of the roller 22 than the end portions, in terms of the direction Y which is perpendicular to the recording medium conveyance direction X. Therefore, the end portions of the fixation nip N4 are likely to be narrower than the center portion of the fixation nip N4.

As described above, the change in hardness of the elastic layer 22*b* of the roller 22 is affected by whether sheets P of recording medium are continuously conveyed or intermittently, or recording medium size or the like factors. Therefore, the elastic layer 22*b* becomes nonuniform in hardness in terms of the direction Y which is perpendicular to the recording medium conveyance direction X. Therefore, it is possible that the shape of the fixation nip N4 becomes such that the end portions are wider than the center portion (which hereafter may be referred to as "fatty-end nip"). Further, it is possible that the shape of the fixation nip N4 will become such that the center portion of the fixation nip N4 is wider than the end portions (which hereafter may be referred to as "fatty-center nip").

In a case where the end portions of a fixation nip become wider than the center portion, the length of time it takes for a sheet P of recording medium to be conveyed through the end portions becomes longer, and therefore, the end portions become greater in the amount by which they transfer heat to the recording medium and toner thereon, more effectively melting the toner, than that through the center portion. Therefore, it is possible that hot-offset will occur across the portions of the film 20, which correspond in position the end portions of the fixation nip. On the other hand, in a case where the center portion of the fixation nip became wider, the length of time it takes for the sheet P to be conveyed through the end portions of the nip is shorter than that through the center portion, being therefore smaller in the amount by which they transmit heat to the sheet P and toner thereon, making it possible that insufficient fixation will occur in the end portions of the nip.

Therefore, if the controlling portion 61 determines that the fixation nip N4 is wider across the end portions, it reduces the heat generating resistor 23*e*2 in the amount of heat generation, in relative terms, whereas if it determines that the fixation nip N4 is wider across the center portion, it reduces the heat generating resistor 23*e*1.

Shown in Table 3 is the relationship among the nip width difference of the fixation nip N4 (=width of end portion of fixation nip N4−width of center portion of fixation nip N4), and power supply duty ratio necessary to enable the fixing apparatus B to uniformly fix an unfixed toner image at a preset (satisfactory) level across its entire length of the fixation nip N4 in terms of the direction Y which is perpendicular to the recording medium conveyance direction X.

Here, "width of the center portion of the nip" means the nip width calculated from the digital signals outputted from the light sensing elements of the line sensor 54, which correspond in position to the center portion of the roller 22. "Width of the end portion of the nip" means the average of the two nip widths calculated from the digital signals outputted from the two light sensing elements of the line sensor 54, which are 138.5 mm away from the center of the roller 22 toward the lengthwise ends, one for one. That is, "nip width difference" is the difference in width between the end portions of the fixation nip N4 and the center portion of the fixation nip N4. By the way, $\alpha$ and $\beta$ in Table 3 are such values that are to be set for each of various recording medium sizes.

TABLE 3

| Nip shape | Difference of nip width | Energization duty ratio |
|---|---|---|
| Middle portion large nip | −0.5 mm | $\beta/(\alpha - 0.2)$ |
| | −0.3 mm | $\beta/(\alpha - 0.1)$ |
| Flat nip | 0.0 mm | $\beta/\alpha$(Ref.) |
| End portion large nip | +0.3 mm | $(\beta - 0.1)/\alpha$ |
| | +0.5 mm | $(\beta - 0.2)/\alpha$ |

Therefore, the controlling portion 61 changes the ratio (temperature setting) between the duty of the power supply to the heat generating resistor 23*e*2 and that to the heat generating resistor 23*e*1, based on the nip width difference of the nip impression N4*m* read by the image reading apparatus 50, and the relationship between nip width difference and power supply duty ratio (temperature setting) given in Table 3. Therefore, it is possible to prevent the occurrence of such issues as hot-offset and under fixation. That is, it is possible to prevent the occurrence of the image defects attributable to the changes in the nip width. By the way, the nip widths and power supply duty ratios in Table 3 are stored in the form of a table in the memory of the controlling portion 61.

By the way, image forming apparatus 50 used in this embodiment is compatible with the first embodiment.

Embodiment 3

Next, another example of image forming apparatus 100 is described. In this embodiment, the image forming portion A of the image forming apparatus 100 is changed in its settings based on the results of reading of a nip image tb of the secondary transfer nip N3 by the image reading apparatus 30. Here, "image formation setting" means the setting for the voltage for transferring the nip image tb onto a sheet P of recording medium.

Next, referring to FIGS. 1 and 19, the image forming apparatus 100 in this embodiment is described. FIG. 19 is a schematic sectional view of a combination of the belt 7 and secondary transfer roller 8 which forms the secondary transfer nip N3.

Referring to FIG. 19, the secondary transfer roller 8 is an electrically conductive roller. This roller 8 is such a member that is made up of a shaft 8*a*, and an foamed elastic layer 8*b* formed on the peripheral surface of the shaft 8*a*. The shaft 8*a* is formed of such a metallic substance as SUS, and is 6 mm in external diameter. The foamed elastic layer 8*b* is 12 mm in external diameter. The secondary transfer roller 8 is 10E6-10E9Ω in electrical resistance. The roller 8 is pressed upon the outward surface of the belt 7, with the presence of a sheet P of recording medium between itself and belt 7. As secondary transfer bias, which is positive in polarity and has a preset level of voltage, is applied to the shaft 8*a*, the roller 8 causes the toner image on the belt 7 to transfer onto the sheet P.

Each time a printing operation is carried out by the image forming apparatus 100, the foamed elastic layer 8*b* of the roller 8 is shaved by the friction from a sheet P of recording medium. Therefore, the roller 8 reduces in external diameter. Further, the application of the secondary transfer bias to the secondary transfer roller 8 makes the foamed elastic layer 8*b* harden (deteriorate). Therefore, repetition of a printing operation by the image forming apparatus 100 tends to reduce the nip N3 in the width in terms of the recording medium conveyance direction X.

FIG. 20 is a graph which shows the relationship between the secondary transfer bias and secondary transfer efficiency. The definition of the secondary transfer efficiency in this embodiment can be expressed in the form of the following formula (Formula 4).

$$\text{Transfer efficiency}=T2/T1\times 100 \qquad \text{Formula 4}$$

T1: amount of toner of solid image on belt 7, per unit area, before solid image is transferred onto sheet P of recording medium T2: amount by which toner is transferred from belt 7 onto sheet P Referring to FIG. 20, the solid line represents the transfer efficiency for the secondary color. In a case where secondary transfer bias is small, the electric field generated in the nip N3 by the secondary transfer bias is weak. Therefore, the toner is insufficiently transferred. That is, the nip N3 reduces in transfer efficiency. In comparison, as the secondary transfer bias is increased, the nip N3 increases in the secondary color transfer efficiency. The single-dot chain line represents the transfer efficiency for the primary color. In a case where the secondary transfer bias is strong, an excessive amount of electrical discharge occurs in the nip N3, and therefore, the nip N3 reduces in transfer efficiency. That is, reducing the secondary transfer bias reduces the occurrence of electrical discharge in the nip N3, and therefore, increases the nip N3 in transfer efficiency.

As electrical discharge occurs in the nip N3, some toner particles change in polarity from positive to negative. Toner particles which are positive in polarity cannot be transferred from the outward surface of the belt 7 onto a sheet P of recording medium. Therefore, if a substantial amount of electrical discharge occurs in the nip N3, the nip N3 reduces in transfer efficiency. Referring to FIG. 20, the optimal secondary transfer bias corresponds to the intersection between the curved line which represents the transfer efficiency for the primary color, and that for the secondary color. The effectiveness of the secondary transfer bias is affected by the width of the nip N3.

In this embodiment, it was found that as the nip N3 reduced in width, the optimal transfer bias becomes higher. FIG. 21 is an overlaid combination of FIG. 20, and another graph which shows the relationship between the secondary transfer bias and secondary transfer efficiency after the nip N3 reduced in width.

Referring to the line in FIG. 21, which represents the transfer efficiency for the secondary color, in order to provide the nip N3 with the same level of transfer efficiency as that prior to the narrowing of the nip N3 even after the narrowing of the nip N3, the secondary transfer bias has to be increased, and the optimal secondary transfer bias roughly horizontally shifts to the side where the transfer bias is higher. As for the transfer efficiency for the primary color, even if the nip N3 reduces in width, and therefore, the secondary transfer bias is increased, the nip N3 remains relatively high in secondary transfer bias efficiency. Thus, it is reasonable to think that this phenomenon is attributable to the fact that the reduction in the nip width reduces the amount by which electrical discharge occurs in the nip. That is, it was discovered in this embodiment that after the narrowing of the nip N3, the optimal secondary transfer bias was higher than that prior the narrowing of the nip N3.

In this embodiment, therefore, the value to which the secondary transfer bias is to be set is determined based on the relationship between the results of the reading of the width of the nip N3, which tends to be reduced in width, in terms of the recording medium conveyance direction X, by the repetition of a printing operation, and the relationship between the nip width and optimal secondary transfer bias, such as the one shown in FIG. 22.

Next, a concrete procedure for detecting the width of the nip N3 is described.

In the memory of the image formation controlling portion (unshown) of the image forming apparatus 100 in this embodiment, a nip width measurement sequence which is to be carried out to measure the width of the nip N3, in terms of the recording medium conveyance direction X, is stored, in addition to the image formation sequence for carrying out the ordinary printing operation described above.

The nip width measurement sequence is carried out by the image formation controlling portion as follows. To begin with, the nip width measurement image (specifically patterned) stored in the memory is opened. Then, a toner image which has a pattern C for measuring the nip width is formed on the outward surface of the belt 7 through the same operation as the image forming operation described above.

That is, the charging process, exposing process, developing process, and primary transferring process are carried out by the charge roller 2, scanner 3, development roller 4*b*, and primary transfer roller 6, respectively, in the image forming portion A, in synchronism with the rotation of the belt 7, to form a toner image having one or more preset colors. Thus, two or more monochromatic toner images which are different in color are sequentially formed in layers on the outward surface of the belt 7. That is, an unfixed nip width measurement image having a preset pattern, which is to be used for measuring the nip width, is formed on the outward surface of the belt 7 with the used of one or more toners which are different in color.

Thereafter, the sheet S is introduced into the nip N3, without applying the secondary transfer bias to the roller 8, as shown in FIG. 19. Then, while the sheet S is conveyed through the nip N3, the belt 7 is stopped with such timing that a part of the nip width measurement image tb is in the nip N3. Then, the belt 7 is kept stationary for a preset length of time while applying the secondary transfer bias, which is positive in polarity, to the roller 8 from an electric power source v3. Thus, the toner of which the part of the nip width measurement image tb, which is in the nip N3, is formed, is transferred onto the sheet S. Consequently, an unfixed toner image of the nip N3 is formed of toner, on the sheet S. Then, the rotation of the belt 7 is restarted to convey the sheet S, without applying bias to the roller 8.

That is, while the sheet S is conveyed through the nip N3 without application of the secondary transfer bias to the roller 8, the rotation of the belt 7 is stopped, and is kept stationary for a preset length of time. Consequently, a nip image N3*m*, that is, a toner image of the nip N3 is transferred onto the sheet S. FIG. 23 shows the nip image N3*m*, or the toner image of the nip N3, formed on the sheet S.

Thereafter, the sheet S is conveyed through the nip N4 of the fixing apparatus B, whereby the unfixed toner image N3*m* of the nip N3 is fixed to the sheet S. Then, the sheet S is conveyed to the reversal conveyance passage 16 by the reversal rotation of the roller 14. Then, while the sheet S is conveyed by the rotation of the rollers 17 and 18, the toner image N3*m* of the nip N3 is read by the image reading apparatus 30. Then, the sheet S is conveyed through the fixing apparatus B for the second time, and is discharged into the tray 15 by the rotation of the roller 14.

FIG. 24 is a block diagram of a combination of the image reading apparatus 30, electric power source driving circuit 70, and secondary transfer bias power source V3. It shows the relationship among the apparatus 30, circuit 70, and power source V3. While the image formation sequence and nip width measurement sequence are carried out, the power source driving circuit 70 is controlled by the image formation controlling portion.

As the image N3*m* of the nip N3, which is formed of the toner, is read by the image reading apparatus 30, digital signals are outputted by the light sensing elements of the line sensor 32, which are correspondent with the center of the roller 8, in terms of the direction Y which is perpendicular to the recording medium conveyance direction X. These digital signals are used to determine the width of the nip N3. FIG. 25 shows the relationship between the magnitude of the digital signals described above, and the positions in the nip N3, in particular, the positions which correspond to the nip N3, or the center portion of the roller 8.

The controlling portion 71, as a controlling means, is made up of a CPU, and such memories as RAM and ROM. Referring to FIG. 25, the controlling portion 71 interprets that the area of the sheet S, which was higher in the voltage of the digital signal, corresponds to the nip image N3*m*, and the width of this portion is equivalent to the width of the nip N3, in terms of the recording medium conveyance direction X. That is, in this embodiment, the controlling portion 71 interprets that the portion of the nip width measurement image tb, which is higher in the voltage of the digital signal, than the threshold value Vt, corresponds to the nip image N3*m*, and the width of this portion is the same as the width of the nip N3, in terms of the recording medium conveyance direction X.

Referring to FIG. 22, in the memory of the controlling portion 71, a table such as the one in FIG. 22 which shows the relationship between the nip width and optimal secondary transfer bias is stored. The controlling portion 71 changes the secondary transfer bias, based on the width of the image N3*m* of the nip N3 read by the image reading apparatus 30, and the relationship between the nip width and optimal secondary transfer bias. Therefore, even if the nip N3 changes in width, the optimal secondary transfer bias, that is, such secondary transfer bias that reflects the changed width of the nip N3, is applied to the roller 8 from the power source V3. Therefore, it is possible to prevent the occurrence of the image defects attributable to the change in the width of the nip N3.

By the way, the image reading apparatus 50 used in the second embodiment is also compatible with this embodiment.

Embodiment 4

Next, another example of image forming apparatus 100 is described. In this embodiment, the image formation setting for the image forming portion A are changed according to the results of the reading of the nip width measurement image tc by the image reading apparatus 30. Here, "image formation setting" means the setting for the voltage to be applied to the primary transfer roller 8 to transfer the image of the primary transfer nip N2, onto the belt 7.

Next, referring to FIGS. 26 and 27, the image forming apparatus 100 in this embodiment is described. FIG. 26 is a schematic sectional view of the image forming apparatus 100 in this embodiment. It shows the general structure of the image forming apparatus 100. FIG. 27 is a schematic sectional view of a combination of the development roller 4*b*, belt 7, photosensitive drum 1, and primary transfer roller 6. In this case, the primary transfer nip N2 is formed by a combination of the belt 7 and photosensitive drum 1.

Referring to FIG. 26, in the case of the image forming apparatus 100 in this embodiment, the image reading apparatus 30 is positioned between the downstream side of the image forming station SK in terms of the rotational direction of the belt 7.

Referring to FIG. 27, the primary transfer roller 6 is an electrically conductive roller. This roller 6 is such a member that is made up of a shaft 6*a*, and a foamed elastic layer 6*b* formed on the peripheral surface of the shaft 6*a*. The shaft 6*a* is formed of such a metallic substance as SUS. The primary transfer roller 6 is provided with a preset amount of electrical resistance. The belt 7 is pressed upon the peripheral surface of the photosensitive drum 1 by the roller 6, forming thereby the primary transfer nip N2 between belt 7 and the photosensitive drum 1. As primary transfer bias, which is preset in polarity and has a preset level of voltage, is applied to the shaft 6*a*, the roller 6 causes the toner image on the photosensitive drum 1 to transfer onto a sheet P of recording medium.

Each time a printing operation is carried out by the image forming apparatus 100, the peripheral surface of the photosensitive drum 1 is shaved by the friction from the belt 7. Therefore, the photosensitive drum 1 reduces in external diameter. Further, application of the primary transfer bias to the primary transfer roller 6 makes the foamed elastic layer 6*b* harden (deteriorate). Therefore, repetition of a printing operation by the image forming apparatus 100 tends to reduce the nip N2 in width in terms of the rotational direction of the belt 7 (rotational direction of conveying member).

In this embodiment, therefore, the value for the primary transfer bias is determined based on a combination of the results of reading of the width of the nip N2, and the relationship between the nip width and optimal primary transfer bias.

Next, a concrete procedure for detecting the width of the nip N2 is described.

In the memory of the image formation controlling portion (unshown) of the image forming apparatus 100 in this embodiment, a nip width measuring sequence for measuring the width of the nip N2 in terms of the belt rotation direction is stored, in addition to the image formation sequence for the normal printing operation described above.

As the nip width measuring sequence is initiated by the image formation controlling portion, first, the nip width measurement image stored in the memory is opened. Then, an image to for measuring the width of the nip is formed of toner, on the outward surface of the belt 7, through the same operation as the normal image forming operation described above.

That is, the charging process, exposing process, developing process, and primary transferring process are carried out by the charge roller 2, scanner 3, development roller 4*b*, and primary transfer roller 6, respectively, in the image forming portion A, in synchronism with the rotation of the belt 7 to form a toner image having one or more preset colors. Thus, two or more monochromatic toner images which are different in color are sequentially formed in layers on the outward surface of the belt 7.

That is, an unfixed image ta to be used for the measurement of the nip width is formed on the peripheral surface of the photosensitive drum 1, of two or more toners different in color. Thereafter, the sheet S is introduced into the nip N2, without applying the primary transfer bias to the roller 6. Then, while the sheet S is conveyed through the nip N2, the belt 7 is stopped with such timing that a part of the image ta is in the nip N2. Then, the belt 7 is kept stationary for a preset length of time while applying the primary transfer bias, which has preset potential level and polarity to the roller 6 from an electric power source V2. Thus, the toner, of which the part of the image tb, which is in the nip N2, is formed, is transferred onto the belt 7. Consequently, an unfixed image of the nip N2 is formed of the toner, on the belt 7.

That is, during the transfer of a part of the image ta onto the belt 7 in the nip N2, the rotation of the belt 7 is stopped, and the belt 7 is kept stationary for a preset length of time. After the interruption of the transfer of the part of the image ta by the roller 6, that is; while the belt 7 is kept stationary, the primary transfer bias is applied to the roller 6. Thus, an image of the nip N2, which hereafter will be referred to as a nip image N2*m*, is transferred onto the belt 7.

FIG. 28 is a block diagram of a combination of the image reading apparatus 30, electric power source driving circuit 80, and primary transfer bias power source V2. It shows the relationship among the apparatus 30, circuit 80, and power source V2. While the image formation sequence and nip width measurement sequence are carried out, the power source driving circuit 80 is controlled by the image formation controlling portion.

As the nip image N2*m*, which is formed of the toner, is read by the image reading apparatus 30, digital signals are outputted by the light sensing elements of the line sensor 32, which correspond in position with the center of the drum 1, in terms of the axial line of the drum 1. These digital signals are used to determine the width of the nip N2.

The controlling portion 81, as a controlling means, is made up of a CPU, and such memories as RAM and ROM. It obtains the width of the portion of the nip with measurement image tb, which is specified by the signals obtained from the nip image N2*m*, with reference to the threshold value Vt, and uses the width of this portion as the width of the nip N2 in teens of the rotational direction of the belt 7. That is, referring to FIG. 25, in this embodiment, it is assumed that the portion of the graph, the digital signals from which are higher in voltage value than the threshold value Vt is equivalent to the nip N2 in size, and uses the width of this portion as the width of the nip N2 in terms of the rotational direction of the belt.

In the memory of the controlling portion 81, a table which shows the relationship between the width of the primary transfer nip N2 and optimal primary transfer bias is stored. The controlling portion 81 changes the primary transfer bias, based on the width of the image N2*m* of the nip N2 read by the image reading apparatus 30, and the relationship between the nip width and optimal primary transfer bias. Therefore, even if the nip N2 changes in width, the optimal primary transfer bias, that is, such primary transfer bias that reflects the change in the width of the nip N2, to the roller 6 from the power source V2. Therefore, it is possible to prevent the occurrence of the image defects attributable to the change in the width of the nip N2.

By the way, the image reading apparatus 50 used in the second embodiment is compatible with this embodiment.

Embodiment 5

Next, another example of image forming apparatus 100 is described. In this embodiment, settings of the image forming portion A of the image forming apparatus 100 are changed based on the results of reading of the image of the development nip N1 read by the image reading apparatus 30. Here, "image formation setting" means the setting for the voltage to be applied to the development roller 4*b* to develop the latent image on the photosensitive drum 1 with the use of toner.

Next, referring to FIG. 29, the image forming apparatus 100 in this embodiment is described. FIG. 29 is a sectional view of a combination of a development roller 4*b*, a photosensitive drum 1, a belt 7, and a secondary transfer roller 8. The development N1 is formed by the development roller 4*b* and photosensitive drum 1.

Referring to FIG. 29, the development roller 4*b* is an electrically conductive roller. This roller 4*b* is such a member that is made up of a shaft 4*b*1, and a foamed elastic layer 4*b*2 formed on the peripheral surface of the shaft 4*b*1, and a surface layer 4*b*3 formed on the outward surface of the foamed elastic layer 4*b*2. The shaft 4*b*1*a* is formed of such a metallic substance as SUS. The development roller 4*b* has a preset electrical resistance. The roller 4*b* is pressed upon the peripheral surface of the photosensitive drum 1, forming thereby the development nip N1 between itself and photosensitive drum 1. As development bias, which has preset potential level and polarity, is applied to the shaft 4*b*1, the toner on the development roller 4*b* is transferred onto the peripheral surface of the photosensitive drum 1.

Each time a printing operation is carried out by the image forming apparatus 100, the peripheral surface of the photosensitive drum 1 and/or peripheral surface of the roller 4*b* is shaved by the friction between the two, and therefore, the drum 1 and/or roller 4*b* reduces in external diameter. Further, applying the development bias to the development roller 4*b* makes the foamed elastic layer 4*b*2 harden (deteriorate). Therefore, repetition of a printing operation by the image forming apparatus 100 tends to reduce the nip N1 in width in terms of the drum rotation direction.

In this embodiment, therefore, the value to which the development bias is to be set is determined based on the relationship between the results of reading of the width of the nip N1, and the optimal development bias.

Next, a concrete procedure for detecting the width of the nip N1 is described.

In the memory of the image formation controlling portion (unshown) of the image forming apparatus 100 in this embodiment, a nip width measuring sequence for measuring the width of the nip N1 in terms of the drum rotation direction is stored, in addition to the image formation sequence for the normal printing operation described above.

As the nip width measuring sequence is initiated by the image formation controlling portion, first, the nip width measurement image stored in the memory is opened. Then, an image for obtaining the width of the nip N1 is formed on the peripheral surface of the photosensitive drum 1, through the same operation as the normal image forming operation described above.

That is, the charging process and exposing process are carried out by the charge roller 2 and scanner 3, respectively, in the image forming portion A, in synchronism with the rotation of the belt 7 to form latent images for the toner images different in color.

Thus, two or more latent images for monochromatic toner images which are different in color are formed on the peripheral surface of the photosensitive drum 1. Then, the rotation of the photosensitive drum 1 is stopped with such timing that a part of the latent image is in the nip N1, without applying development bias to the roller 4*b*. Then, the drum 1 is kept stationary for a preset length of time. While the drum 1 is kept stationary, a development bias that has preset potential level and polarity is applied to the roller 4*b* by the electrical power source V1, to transfer toner onto the drum 1. Consequently, an unfixed image of the nip N1 is formed on the peripheral surface of the photosensitive drum 1. That is, a unfixed nip image N1*m*, to be used to obtain the nip width, is formed on the peripheral surface of the photosensitive drum 1, of two or more toners which are different in color.

That is, the nip image N1*m*, that is, an image which is the same in shape and dimension as the nip N1, is formed on the peripheral surface of the photosensitive drum 1, by stopping the rotation of the photosensitive drum 1, keeping the photosensitive drum 1 stationary for a preset length of time, and applying development bias to the roller 4*b*.

FIG. 30 is a block diagram of a combination of the image reading apparatus 30, electric power source driving circuit 90, and development bias power source V1. It shows the relationship among the apparatus 30, circuit 90, and power source V1. Also in the image forming apparatus 100 in this embodiment, the image reading apparatus 30 is positioned on the downstream side of the image formation station SK in terms of the belt rotation direction, as shown in FIG. 26. While the image formation sequence and nip width measurement sequence are carried out, the power source driving circuit 90 is controlled by the image formation controlling portion.

As the nip image N1*m*, which is formed of the toner, is read by the image reading apparatus 30. Digital signals are outputted by the light sensing elements of the line sensor 32, which correspond in position with the center of the drum 1, in terms of the axial line of the drum 1. These digital signals are used to determine the width of the nip N1.

The controlling portion 91, as a controlling means, is made up of a CPU, and such memories as RAM and ROM. It interprets the image N1*m* of the nip N1, which is specified by the digital signals with reference to the threshold Vt, to be equivalent to the nip N1, and the width of this nip image N1*m* to be equal to the width of the nip N1 in terms of the rotational direction of the belt 7. That is, referring to FIG. 25, in this embodiment, the controlling portion 91 determines that the portion of the graph, the digital signals from which are higher in voltage value than the threshold value Vt reflects the nip N1 in size, and the width of this portion is equal to the width of the nip N1 in terms of the rotational direction of the belt.

In the memory of the controlling portion 91, a table which shows the relationship between the width of the primary transfer nip N1 and optimal development bias is stored. The controlling portion 91 changes the development bias, based on the width of the image N1*m* of the nip N2 read by the image reading apparatus 30, and the relationship between the nip width and optimal development bias. Therefore, even if the nip N1 changes in width, the optimal development bias, that is, such development bias that reflects the change in the width of the nip N1, to the roller 4*b* from the power source V1. Therefore, it is possible to prevent the occurrence of the image defects attributable to the change in the width of the nip N1.

By the way, the image reading apparatus 50 used in the second embodiment is compatible with this embodiment.

[Miscellanies]

The number of the image reading apparatus 30 or 50 does not need to be limited to one. It is possible to place two image reading apparatuses in such a manner that two apparatuses oppose each other across the recording medium conveyance passage. This arrangement makes it possible to read the nip image on the sheet S with the use of either one of the two image reading apparatuses, making it possible to minimize the number of times the sheet S needs to be conveyed.

The preceding embodiments are not intended to limit the application of the present invention to a full-color printer such as the image forming apparatus 100 in the preceding embodiment, in terms of the choice of image forming apparatus (100) to which the present invention is applicable. For example, the present invention is also applicable to a full-color printer of the direct transfer type, which is structured so that the toner image on the peripheral surface of each photosensitive drum is sequentially transferred directly onto a sheet of recording medium while the sheet is conveyed by its electrostatic conveyance belt. In such a case, the description of the procedure to obtaining the nip width is the same as one of those procedures in the preceding embodiments, except that the belt 7 is replaced by the electrostatic conveyance belt. Further, the present invention is also applicable to a monochromatic printer.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-034593 filed on Feb. 28, 2018, which is hereby incorporated by reference herein in its entirety.

What is claimed is:

1. An image forming apparatus comprising:

(A) an image forming portion for forming an unfixed toner image on a recording material;

(B) a fixing portion including:

(a) a fixing rotatable member;

(b) a heating member configured to heat said fixing rotatable member; and (c) a pressing rotatable member positioned relative to the fixing rotatable member to form a fixing nip therebetween, the pressing rotatable member being configured to cooperate with said fixing rotatable member to fix the toner image on the recording material by heating the recording material carrying the toner image while nipping and feeding the recording material with the fixing nip;

(C) an image reader; and (D) a controller configured to set a temperature condition for said heating member, wherein said image forming apparatus is configured:

(i) to form, by said image forming portion, a toner image pattern for measuring a width of the fixing nip on the recording material;

(ii) to fix the toner image pattern on the recording material by heating the recording material while nipping and feeding the recording material with the fixing nip; and (iii) to refeed the recording material through the fixing nip, during which rotations of said fixing rotatable member and said pressing rotatable member are stopped to provide a trace of the fixing nip on the fixed toner image pattern, wherein said image reader is configured to read a width of the trace of the fixing nip in a recording material feeding direction, the width of the trace read by said image reader being a nip width, and wherein said controller is configured to change the temperature condition in response to a result of the nip width read by said image reader.

2. An image forming apparatus according to claim 1, wherein said controller is configured to change the temperature condition in response to a result of the nip width read by said image reader to provide a target temperature of said heating member.

3. An image forming apparatus according to claim 1, wherein said heating member includes (i) an elongated substrate having an longitudinal direction and (ii) a heat generating resistor extending along the longitudinal direction of the substrate from one lateral end portion to the other lateral end portion of the substrate in terms of the recording material feeding direction.

4. An image forming apparatus comprising:

(A) an image forming portion configured to form an unfixed toner image on a recording material, said image forming portion including:

(a) a rotatable image bearing member;

(b) a first transfer member;

(c) a rotatable feeding member cooperating with said image bearing member to form a first transfer nip, wherein said first transfer member is configured to transfer the toner image from said image bearing member, onto said rotatable feeding member at the first transfer nip; and (d) a second transfer member cooperating with said rotatable feeding member to form a second transfer nip, wherein said second transfer member is configured to transfer the toner image from said rotatable feeding member onto the recording material at the second transfer nip while nipping and feeding the recording material with the second transfer nip;

(B) a fixing portion configured to fix the toner image on the recording material;

(C) an image reader; and (D) a controller configured to set an image forming condition of said image forming portion, wherein said image forming apparatus is configured:

(i) to transfer a toner image pattern for measuring a width of the nip from said image bearing member onto said rotatable feeding member by said first transfer member at the first transfer nip;

(ii) to feed the recording material by the second transfer nip with a transfer operation of the toner image pattern by said second transfer member stopped; and (iii) to stop rotation of said rotatable feeding member and then to carry out the transfer operation of said toner image pattern so that a trace of the second transfer nip is formed on the recording material, wherein said fixing portion fixes the trace on the recording material, wherein said image reader reads a width of the trace of the second transfer nip in a recording material feeding direction, the image reader reading the trace at an end portion and a central portion of the trace of the second transfer nip with respect to a direction perpendicular to the recording material feeding direction, and wherein said controller controls the image forming condition in accordance with a difference between the width of the end portion of the trace of the second transfer nip and the central portion of the trace of the second transfer nip.

5. An image forming apparatus according to claim 4, wherein said image forming condition relates to a voltage applied to said second transfer member to transfer the toner image from said rotatable feeding member onto the recording material.

6. An image forming apparatus comprising:

(A) an image forming portion configured to form an unfixed toner image on a recording material, said image forming portion including:

(a) a rotatable image bearing member;

(b) a first transfer member;

(c) a rotatable feeding member cooperating with said image bearing member to form a first transfer nip, wherein said first transfer member is configured to transfer the toner image from said image bearing member onto said rotatable feeding member at the first transfer nip; and (d) a second transfer member cooperating with said rotatable feeding member to form a second transfer nip, wherein said second transfer member is configured to transfer the toner image from said rotatable feeding member onto the recording material at the second transfer nip while nipping and feeding the recording material with the second transfer nip;

(B) a fixing portion configured to fix the toner image on the recording material;

(C) an image reader; and (D) a controller configured to set an image forming condition of said image forming portion, wherein, during an operation to transfer a toner image pattern for measuring a width of the first transfer nip from said image bearing member onto said rotatable feeding member at the first transfer nip, said image forming apparatus is configured: (i) to stop a transfer operation of the toner image pattern by the first transfer member and (ii) to stop rotation of said rotatable feeding member and then to carry out the transfer operation of the toner image pattern, so that a trace of the first transfer nip is formed on said rotatable feeding member, wherein said image reader reads a width of the trace of the first transfer nip in a peripheral movement direction of said rotatable feeding member, and wherein said controller changes the image forming condition in accordance with a result of reading of the width of the trace of the first transfer nip by said image reader.

7. An apparatus according to claim 6, wherein the image forming condition relates to a voltage applied to said first transfer member to transfer the toner image onto the recording material.

8. An apparatus according to claim 6, wherein said image reader reads, as the width of the trace of the first transfer nip, a range, in a peripheral moving direction of said rotatable feeding member, determined from a signal provided by the trace on the basis of a threshold.

9. An image forming apparatus comprising:

(A) an image forming portion configured to form an unfixed toner image on a recording material, said image forming portion including:

(a) a rotatable image bearing member;

(b) an exposure means configured to form a latent image on said image bearing member;

(c) a developing member cooperating with said image bearing member to form a development nip in which the latent image is developed with toner;

(d) a first transfer member;

(e) a rotatable feeding member cooperating with said image bearing member to form a first transfer nip, wherein said first transfer member is configured to transfer the toner image from said image bearing member onto said rotatable feeding member at the first transfer nip; and (f) a second transfer member cooperating with said rotatable feeding member to form a second transfer nip, wherein said second transfer member is configured to transfer the toner image from said rotatable feeding member onto the recording material at the second transfer nip while nipping and feeding the recording material with the second transfer nip;

(B) a fixing portion configured to fix the toner image on the recording material;

(C) an image reader; and (D) a controller configured to set an image forming condition of said image forming portion, wherein said image forming apparatus is configured to form a latent image for measuring a width of the development nip on said image bearing member by said exposure means, wherein, during an operation to develop the latent image with the toner by said developing member, the image forming apparatus is configured (i) to stop a developing operation of the latent image by said developing member and (ii) to stop rotation of said image bearing member for a predetermined period of time, and then to carry out the developing operation of the latent image to form a trace of the development nip on said image bearing member, wherein said image forming apparatus is configured to transfer the trace of the development nip from said image bearing member onto the feeding member by said first transfer member, wherein said image reader reads a width of the trace of the development nip in a peripheral movement direction of said feeding member, and wherein said controller changes the image forming condition in accordance with a result of reading of the width of the trace of the development nip by said image reader.

10. An apparatus according to claim 9, wherein the image forming condition relates to a voltage applied to said developing member to develop the latent image with the toner.

11. An apparatus according to claim 9, wherein said image reader reads, as the width of the trace of the development nip, a range, in a peripheral moving direction of said feeding member, determined from a signal provided by the trace on the basis of a threshold.

* * * * *